US009188915B2

(12) United States Patent
Sato

(10) Patent No.: US 9,188,915 B2
(45) Date of Patent: Nov. 17, 2015

(54) FUSER CONTROL DEVICE, FUSER CONTROL METHOD AND IMAGE FORMING APPARATUS

(71) Applicant: Oki Data Corporation, Tokyo (JP)

(72) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/086,255

(22) Filed: Nov. 21, 2013

(65) Prior Publication Data

US 2014/0147150 A1 May 29, 2014

(30) Foreign Application Priority Data

Nov. 29, 2012 (JP) ..... 2012-261008

(51) Int. Cl.
*G03G 15/20* (2006.01)

(52) U.S. Cl.
CPC .... *G03G 15/2039* (2013.01); *G03G 2215/2045* (2013.01)

(58) Field of Classification Search
USPC ..... 399/69
See application file for complete search history.

(56) References Cited

U.S. PATENT DOCUMENTS

| | | | | |
|---|---|---|---|---|
| 6,173,136 | B1 * | 1/2001 | Fuchiwaki et al. | 399/67 |
| 8,229,312 | B2 * | 7/2012 | Shinyama | 399/68 |
| 2002/0009306 | A1 * | 1/2002 | Hayashi et al. | 399/69 |
| 2008/0118261 | A1 * | 5/2008 | Kotani | 399/69 |
| 2010/0074643 | A1 * | 3/2010 | Moriguchi | 399/69 |
| 2010/0329720 | A1 * | 12/2010 | Otsuka | 399/69 |
| 2012/0087688 | A1 * | 4/2012 | Kubota | 399/69 |
| 2013/0089364 | A1 * | 4/2013 | Michibata | 399/361 |
| 2014/0212161 | A1 * | 7/2014 | Cutts et al. | 399/70 |

FOREIGN PATENT DOCUMENTS

JP 10-104990 A 4/1998

* cited by examiner

*Primary Examiner* — Rochelle-Ann J Blackman
*Assistant Examiner* — Linda B Smith
(74) *Attorney, Agent, or Firm* — Muncy, Geissler, Olds & Lowe, P.C.

(57) ABSTRACT

A fuser control device that controls a fuser that heats and fuses developer on a medium for an image formation on the medium includes the fuser including a heating member that rotates while contacting and heating the medium, and a rotation member that rotates and sandwiches the medium with the heating member; a heat supply part that supplies heat to the heating member; a temperature detection part that detects a temperature of the heating member; a heating controller that controls the heat supply part based on a detection result by the temperature detection part; and a rotation controller that controls a rotational speed of the heating member.

17 Claims, 17 Drawing Sheets

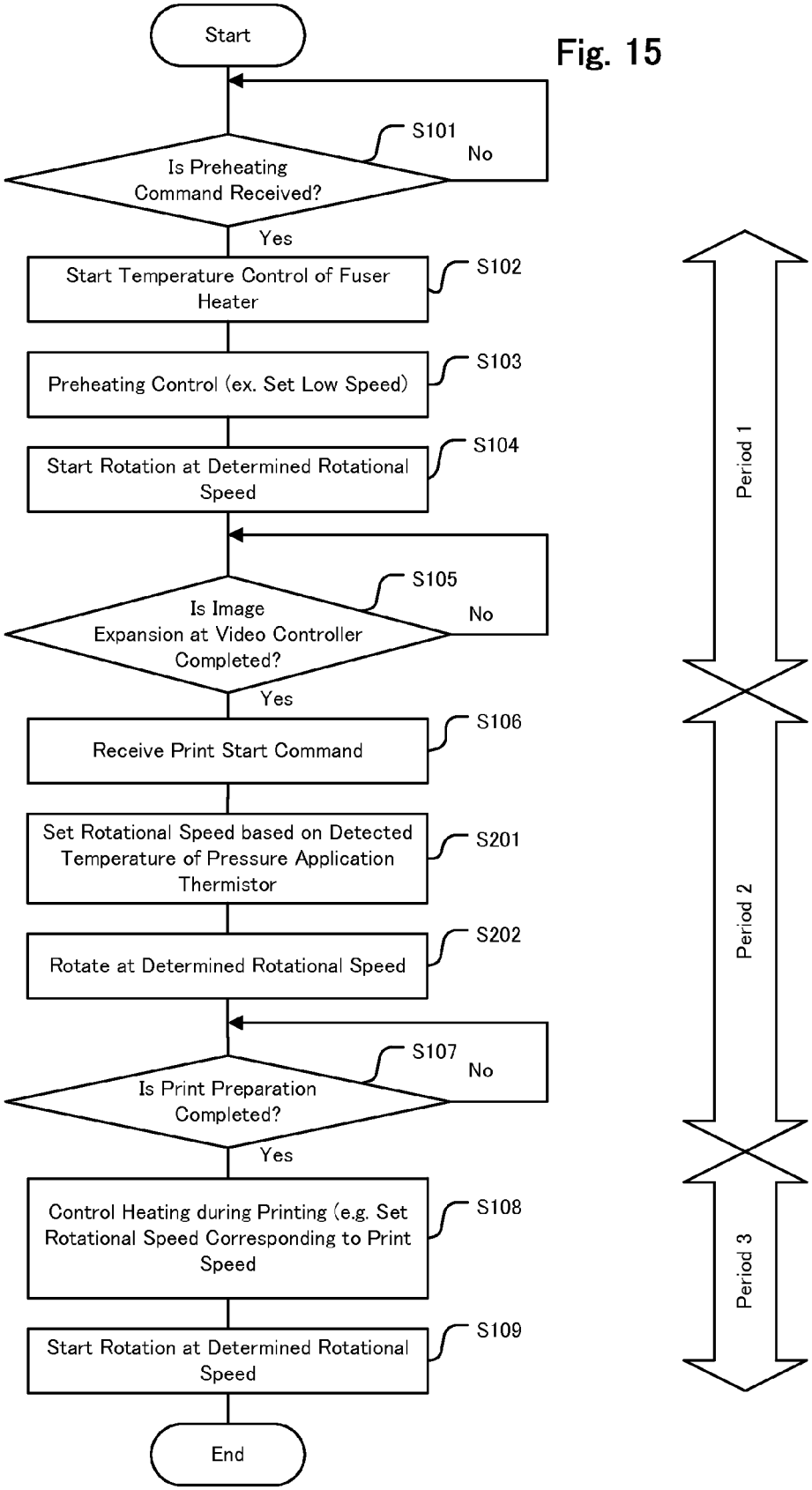
Fig. 15
Start
S101
Is Preheating Command Received?
No
Yes
S102
Start Temperature Control of Fuser Heater
S103
Preheating Control (ex. Set Low Speed)
S104
Start Rotation at Determined Rotational Speed
S105
Is Image Expansion at Video Controller Completed?
No
Yes
S106
Receive Print Start Command
S201
Set Rotational Speed based on Detected Temperature of Pressure Application Thermistor
S202
Rotate at Determined Rotational Speed
S107
Is Print Preparation Completed?
No
Yes
S108
Control Heating during Printing (e.g. Set Rotational Speed Corresponding to Print Speed
S109
Start Rotation at Determined Rotational Speed
End
Period 1
Period 2
Period 3

FUSER CONTROL DEVICE, FUSER CONTROL METHOD AND IMAGE FORMING APPARATUS

CROSS REFERENCE TO RELATED APPLICATION

The present application is related to, claims priority from and incorporates by reference Japanese Patent Application No. 2012-261008, filed on Nov. 29, 2012.

This invention relates to a fuser control device, a fuser control method and an image forming apparatus, which may be utilized in an image forming apparatus, such as a printer, a facsimile device and the like.

For example, an image forming apparatus, such as an electrographic printer and the like, transfers a toner image formed on a surface of a photosensitive body onto a sheet, and a fuser fuses an image on the sheet by heat and pressure.

Conventionally, the fuser includes two rollers (rotation members) as pressure application members that are positioned via a sheet carrying path, and a heating member. Then, as the sheet on which the toner image has been transferred is carried between the two rollers, the image is fused to the sheet by heat and pressure (see Japanese Patent No. 3171797 (Japanese Laid-Open Patent Application No. 10-104990))

At the heating member, temperature is detected by a temperature detection part, such as a thermistor or the like, and a heating controller adjusts temperature of the heating member by performing a drive control for a heater in accordance with the detected temperature by the temperature detection part and a print condition.

However, the temperature of a rotation body that contacts the medium often increases too much, thereby causing occurrence of miscarrying of the medium.

Therefore, there is desirability for a fuser control device, a fuser control method and an image forming apparatus that reduce the occurrence of miscarrying by adjusting rotational speed of the rotation members of the fuser.

SUMMARY

A fuser control device, which is disclosed in the application, that controls a fuser that heats and fuses developer on a medium for an image formation on the medium includes the fuser including a heating member that rotates while contacting and heating the medium, and a rotation member that rotates and sandwiches the medium with the heating member; a heat supply part that supplies heat to the heating member; a temperature detection part that detects a temperature of the heating member; a heating controller that controls the heat supply part based on a detection result by the temperature detection part; and a rotation controller that controls a rotational speed of the heating member.

According to this invention, the occurrence of miscarrying is reduced by adjusting rotational speed of the rotation members of the fuser.

BRIEF DESCRIPTION OF THE DRAWINGS

FIG. 15 is an explanatory diagram explaining a detailed operation of the fuser control process by the fuser control device according to the second embodiment.

DETAILED DESCRIPTION OF THE EMBODIMENT(S)

(A) First Embodiment

A first embodiment of a fuser control device, a fuser control method and an image forming apparatus of this invention is explained below in detail with reference to the drawings.

(A-1) Structure of First Embodiment

(A-1-1) Internal Structure of Image Forming Apparatus

Figure 2:
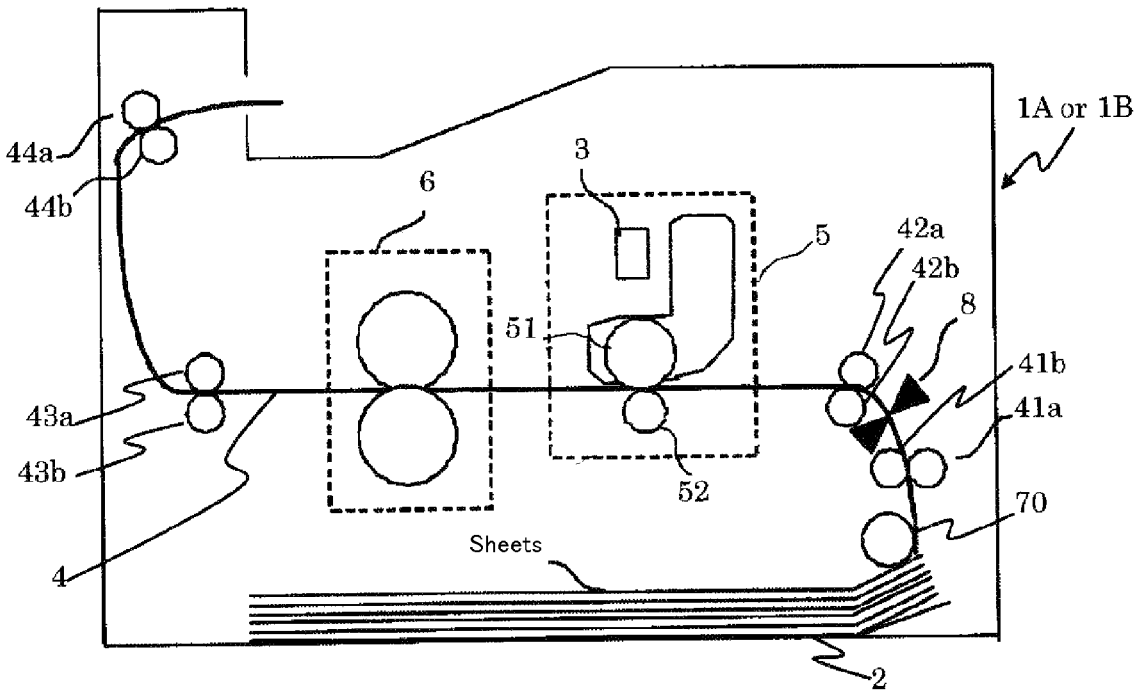
FIG. 2 is a structural diagram illustrating a schematic internal structure of the image forming apparatus according to the first embodiment.

FIG. 2 is a structural diagram illustrating a schematic internal structure of the image forming apparatus according to the first embodiment. In FIG. 2, an image forming apparatus 1A according to the first embodiment includes a sheet cassette 2, a sheet carrying path 4, a sheet supply roller 70, carrying rollers 41*a* and 41*b*, a writing sensor 8, carrying rollers 42*a* and 42*b*, a light emitting diode (LED) head 3 as an exposure part, a toner image forming part 5 as an image forming part, a fuser 6, ejection rollers 43*a* and 43*b*, and ejection rollers 44*a* and 44*b*.

In the image forming apparatus 1A, the sheet carrying path 4 is a carrying path for carrying a sheet as a medium and is in an approximately S-shape. Sheets are accommodated in the sheet cassette 2, and the sheet supply roller 70 picks up each sheet from the sheet cassette 2. The sheet picked up by the sheet supply roller 70 is fed to the sheet carrying path 4 by the carrying rollers 41*a* and 41*b* and the carrying rollers 42*a* and 42*b*.

The writing sensor 8 is a medium position detection part that is positioned between the carrying rollers 41*a* and 41*b* and the carrying rollers 42*a* and 42*b* and that detects a carrying position of the sheet fed to the sheet carrying path 4. The writing sensor 8 provides a detection signal to a later described print controller 100 when the wiring sensor 8 detects the carrying position of the sheet.

The LED head 3 is positioned adjacent to a toner image forming part 5 and exposes a surface of a photosensitive body (e.g., photosensitive drum) 51 with recording light based on obtained image data. In the first embodiment, a case where a LED head configured from a plurality of LED elements is used as the exposure part is discussed as an example. However, a conventional exposure device may be used.

The toner image forming part 5 transfers a toner image formed on the surface of the photosensitive drum 51 onto the carried sheet. A conventional image forming part may be widely used as the toner image forming part 5.

The toner image forming part 5 is configured by including the photosensitive drum 51. The photosensitive drum 5 is exposed by the LED head 3, and thereby an electrostatic latent image is formed on the surface of the photosensitive drum 51. In addition, the toner image forming part 5 causes toner accommodated in a toner cartridge to be attached onto the electrostatic latent image on the surface of the photosensitive drum 51 to form a toner image on the surface of the photosensitive drum 51. Then, the toner image forming part 5 causes the sheet to pass between the photosensitive drum 51 and a transfer roller 52 that faces the photosensitive drum 51 and transfers the toner image on the surface of the photosensitive drum 51 onto the sheet. As a result, the toner image moves onto the sheet, and the sheet is carried to the fuser 6.

The fuser 6 includes two facing rotation bodies and fuses the toner image by pinching the medium that passes between the two facing rotational bodies and by applying heat and pressure to the medium.

Here, as a fusing method by the fuser 6, a roller method, a fusing film method and the like may be used. In the roller method, two rollers are positioned as the two facing rotation bodies, and at least one roller is rotated while heat from a heater and pressure are applied. In the fusing film method, a film is positioned as at least one of the two rotation bodies in the roller method, and the film is heated by a heater. Then, the heated film is rotated while pressure is applied to the film and the medium that contacts the film. In this embodiment, a case that uses the fusing film method at the fuser 6 is discussed as an example.

(A-1-2) Internal Configuration of Control System of Image Forming Apparatus

Figure 1:
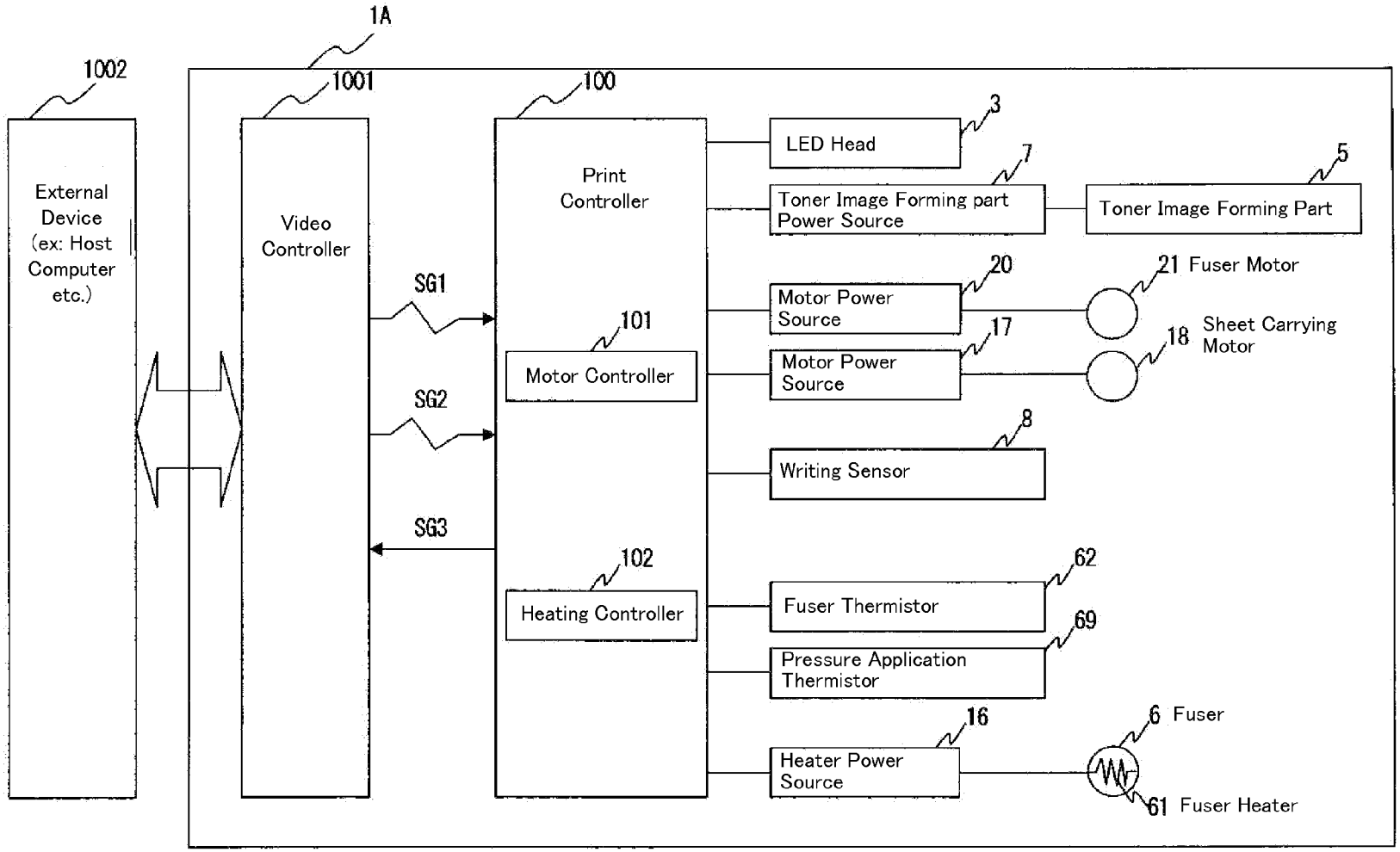
FIG. 1 is a structural diagram illustrating an internal structure of a control system of an image forming apparatus according to a first embodiment.

FIG. 1 is a structural diagram illustrating an internal structure of a control system of the image forming apparatus 1A according to the first embodiment.

In FIG. 1, the image forming apparatus 1A according to the first embodiment includes a video controller 1001 and a print controller 100 as controllers, the LED head 3, a toner image forming part power source 7, a motor power source 20, a motor power source 17, the writing sensor 8, a fuser thermistor 62, a pressure application thermistor 69, a heater power source 16, the toner image forming part 5, a fuser motor 21, a sheet carrying motor 18, the fuser 6 and a fuser heater 61.

FIG. 1 illustrates as an example a case where the image forming apparatus 1A is connected to an external device 1002 and performs print operations based on image data obtained from the external device 1002.

The external device 1002 may be a host computer, such as a personal computer, and provides the image data to the image forming apparatus 1A.

The video controller 1001 is an example of an image processing part. The video controller 1001 obtains the image data from the external device 1002, performs image expansion based on the obtained image data, and provides a video signal, which is dot map data, for example, to the print controller 100. The video controller 1001 is a device configured by including a central processing unit (CPU), a read only memory (RAM), a random access memory (RAM), an input/output interface and the like. The process of the video controller 1001 is achieved as the CPU executes a process program stored in the ROM.

Figure 3:
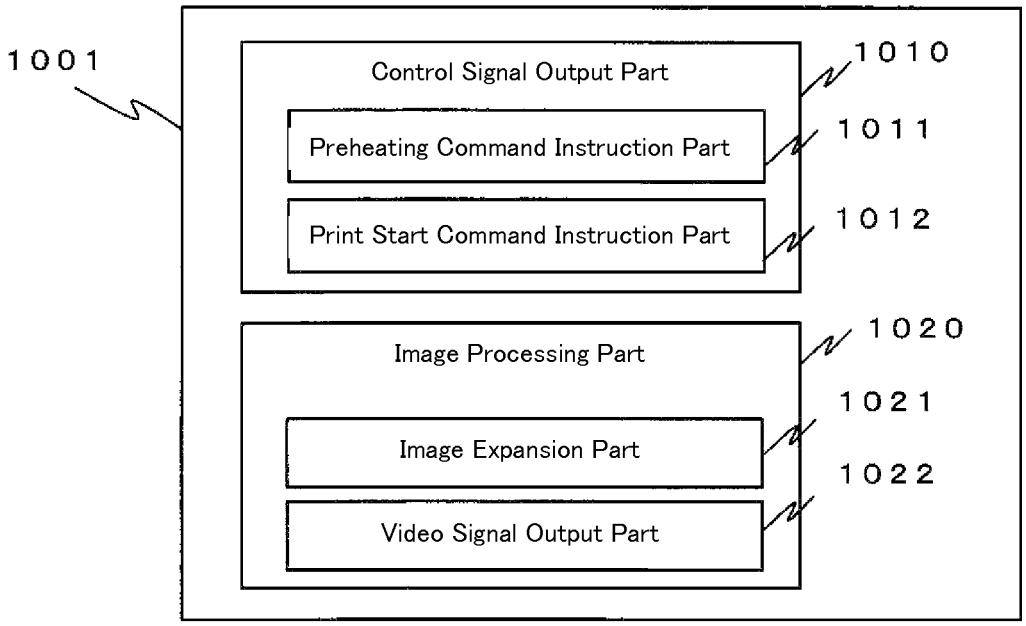
FIG. 3 is an internal structural diagram illustrating an internal structure of a video controller according to the first embodiment.

FIG. 3 is an internal structural diagram illustrating an internal structure of the video controller 1001. As shown in FIG. 3, the video controller 1001 includes a control signal output part 1010 and an image processing part 1020.

The control signal output part 1010 outputs a control signal SG1 relating to the print operation to the print controller 100. The control signal output part 1010 includes a preheating command instruction part 1011 and a print start command instruction part 1012.

The preheating command instruction part 1011 outputs a preheating command to the print controller 100 at the same time as when the image expansion based on the image data obtained from the external device 1002 starts.

Here, the preheating command is a command that provides instructions for starting up the fuser heater 61 of the fuser 6 as discussed later and for rotating and driving the fuser motor 21 so as to prevent a temperature of a fusing contact part (fusing nip part) between an upper pressure application roller 63 and a lower pressure application roller 65 of the fuser 6 from being excessively increased.

In addition, the preheating command is outputted to the print controller 100 prior to the later-discussed print start command. The preheating command instruction part 1011 may output the preheating command prior to starting the image expansion.

The print start command instruction part 1012 outputs the print start command that causes the print cooperation to be started to the print controller 100 when the image expansion based on the image data from the external device 1002 is completed.

The image processing part 1020 performs an image process based on the image data obtained from the external device 1002. The image processing part 1020 includes an image expansion part 1021 that expands the image based on the obtained image data, and a video signal output part 1022 that, after the completion of the image expansion by the image expansion part 1021, outputs dot map data that is resulted from the image expansion and that is one-dimensionally arranged, as a video signal SG2 to the image controller 100.

The print controller 100 controls the print operation based on the control signal SG1 from the video controller 1001. The print controller 100 is a device configured by including, for example, a microprocessor, a ROM, a RAM an input/output interface, a timer and the like. Various functions of the print controllers 100 are achieved as the microprocessor executes process programs stored in the ROM.

The print controller 100 is connected to the video controller 1001, the LED head 3, the toner image forming power source 7, the motor power source 20, the motor power source 17, the writing sensor 8, the fuser thermistor 62 as a fusing film temperature detection part, the pressure application thermistor 69 as a pressure application roller temperature detection part, and the heater power source 16, and controls the operation of each of these configuration elements.

Moreover, the print controller 100 includes a motor controller 101 that is a rotation controller and a heating controller 102 as shown in FIG. 2, as functions achieved by the print controller 100.

The motor controller 101 is a rotation controller that controls operation of the toner forming power source 7, the motor power source 20 and the motor power source 17 based on the control signal SG1 from the video controller 1001.

Figure 4:
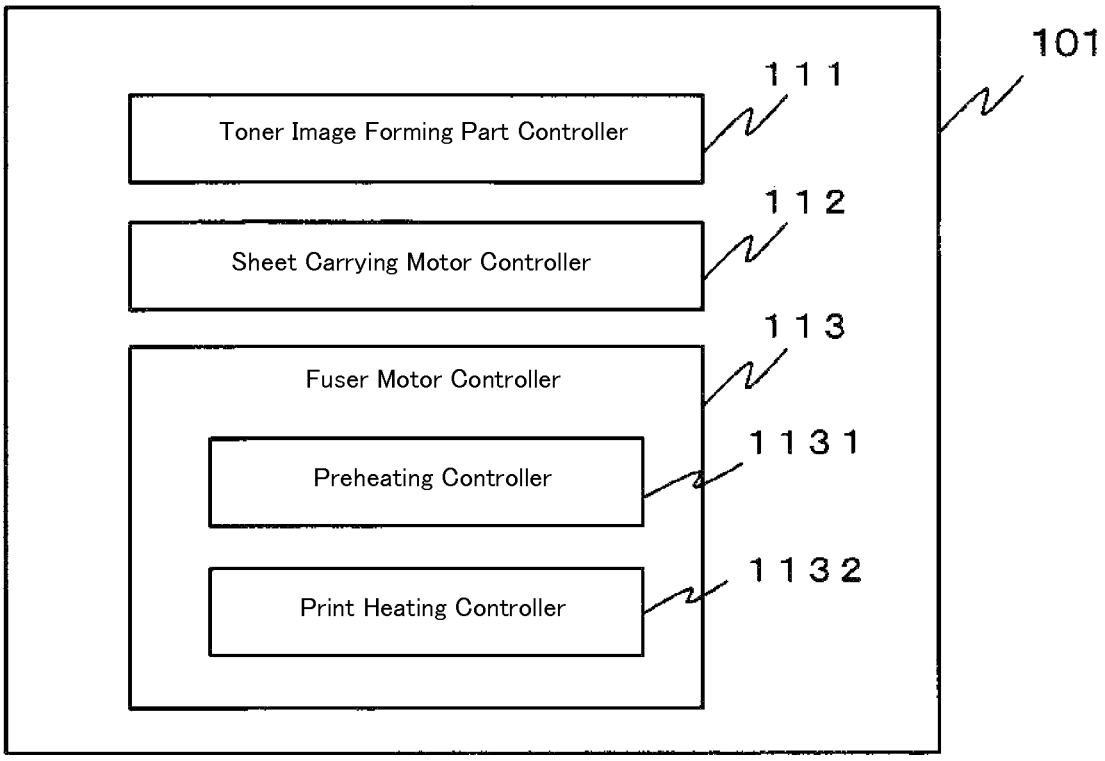
FIG. 4 is a block diagram illustrating a functional structure of a motor controller according to the first embodiment.

FIG. 4 is a block diagram illustrating a functional structure of the motor controller 101 according to the first embodiment. In FIG. 4, the motor controller 101 includes a toner image forming part controller 111, a sheet carrying motor controller 112, and a fuser motor controller 113.

The toner image forming part controller 111 starts the toner image forming part power source 7 and commences power supply to the toner image forming part 5 when the print start command is obtained from the video controller 1001.

The sheet carrying motor controller 112 causes the sheet supply roller 70 to pick up a sheet from the sheet cassette 2 after completion of print preparation and drives the sheet carrying motor 18 by controlling the motor power source 17 when a sheet carrying position detection signal is obtained from the writing sensor 8.

The fuser motor controller 113 starts the motor power source 20 based on the control signal SG1 from the video controller 1001 and controls power supply to the fuser motor 21. That is, the fuser motor controller 113 adjusts rotation speed of the later-discussed lower pressure application roller 65 (drive roller of two rollers, see FIG. 5) of the fuser 6 by controlling drive of the fuser motor 21.

Here, the fuser motor controller 113 includes a preheating controller 1131 and a print heating controller 1132.

The preheating controller 1131 controls rotation and driving of the lower pressure application roller 65 of the fuser 6 at present low rotational speed when the preheating command is obtained from the video controller 1001.

The print heating controller 1132 rotates the lower pressure application roller 65 of the fuser 6 at preset high rotational speed after obtaining the print start command from the video controller 1001 and after the completion of print preparation.

As discussed above, as the preheating controller 1131 causes the roller of the fuser 6 to rotate at low rotational speed prior to starting the printing and as the print heating controller 1132 causes the roller of the fuser 6 to rotate at high rotational speed during the execution of the printing, the temperate at the fusing nip part of the rollers of the fuser 6 is prevented from being excessively increased.

In the first embodiment, a case where the preheating controller 1131 and the print heating controller 1132 control rotation of the roller of the fuser 6 at preset low and high rotational speeds, is discussed as an example. That is, a case where the preheating controller 1131 causes the lower pressure application roller 65 to rotate at a preset low rotational speed.

However, the preheating controller 1131 may cause the lower pressure application roller 65 to rotate at two or more rotational speeds that are lower than the rotational speed during the execution of the printing. In that case, the preheating controller 1131 may control, in stages, rotation of the lower pressure application roller 65 at two or more different rotational speeds or may control the rotational speed so as to gradually increase in accordance with the time, for example.

The heating controller 102 starts the heater power supply 16 and supplies power to the fuser heater 61 of the fuser 6 when the preheating command is obtained from the video controller 1001.

Moreover, the heating controller 102 receives detected temperature information detected by the fuser thermistor 62 and the pressure application thermistor 69 and performs temperature control on the heater power source 16 by the detected temperature information from the fuser thermistor 62 and the pressure application thermistor 69.

The toner image forming part power source 7 supplies power to the toner image forming part 5 under control of the print controller 100.

The motor power source 20 supplies power to the fuser motor 21 that drives the fuser 6 under control of the print controller 100.

The motor power source 17 supplies power to the sheet carrying motor 18 that drives each carrying roller, a carrying belt and the like on the sheet carrying path 4 under control of the print controller 100.

The fuser thermistor 62 is a temperature detection member that detects a surface temperature of the later-discussed fusing film 64 (see FIG. 5) of the fuser 6. The fuser thermistor 62 provides detected temperature information of the fusing film 64 to the print controller 100.

The pressure application thermistor 69 is a temperature detection member that detects a surface temperature of the later-discussed lower pressure application roller 65 (see FIG. 5) of the fuser 6. The pressure application thermistor 69 provides the detected temperature information of the lower pressure application roller 65 to the print controller 100.

(A-1-3) Structure of Fuser Control Device

Figure 5:
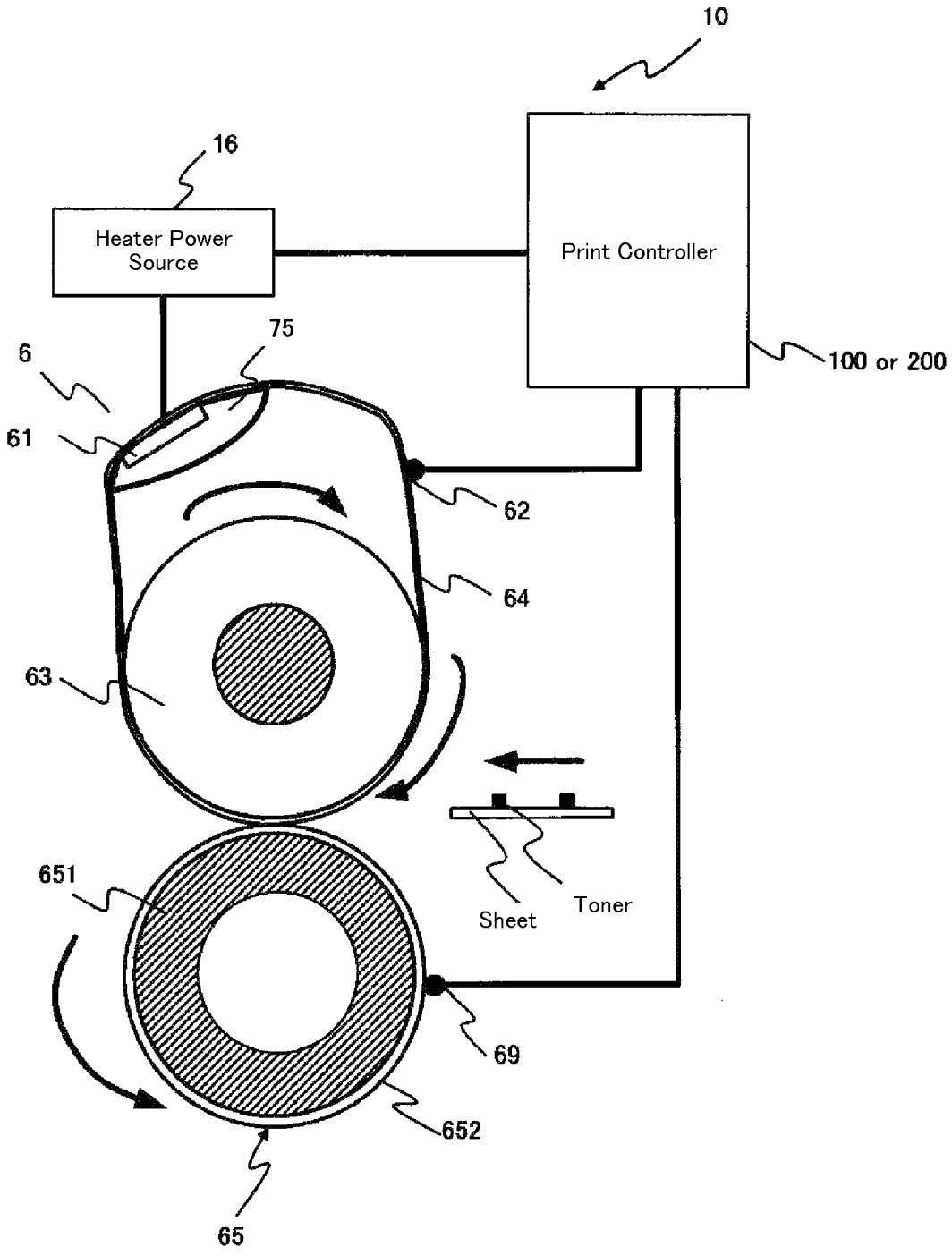
FIG. 5 is a structural diagram illustrating a structure of a fuser control device according to the first embodiment.

FIG. 5 is a structural diagram illustrating a structure of the fuser control device according to the first embodiment. The fuser 6 shown in FIG. 5 is an example of a fuser utilizing the fusing film method.

In FIG. 5, the fuser control device 10 of the first embodiment includes the print controller 100, the heater power source 16, the fuser 6, the fuser thermistor 62 and the pressure application thermistor 69.

In FIG. 5, the print controller 100, the heater power source 16, the fuser thermistor 62 and the pressure application thermistor 69 are structural elements that are explained using FIGS. 1 and 4.

The fuser 6 includes the lower pressure application roller 65, the upper pressure application roller 63, the fusing film 64, the fuser heater 61 and the heater support member 75.

The upper pressure application roller 63 and the lower pressure application roller 65 are examples of pressure application members that fuse an image on the carried sheet by pressure. The upper pressure application roller 63 and the lower pressure application roller 65 are positioned to face each other. The image is fused on the sheet by applying pressure to the sheet that passes between the upper pressure application roller 63 and the lower pressure application roller 65.

The lower pressure application roller 65 is connected to a gear that receives a rotational force from the fuser motor 21 (see FIG. 1) and is a drive roller that is rotated and driven by the rotational force from the fuser motor 21. The drive roller may be referred to as a first rotation member.

The lower pressure application roller 65 contacts the upper pressure application roller 63 via the fusing film 64 and forms the fuser contact part (fusing nip part) with the upper pressure application roller 65.

The lower pressure application roller 65 is a roller having an outer diameter of 40 mm, for example. The lower pressure application roller 65 is configured from a core 651 as a base body formed by a metal solid shaft and the like made of metal (e.g., steel), and a heat resistant porous sponge elastic layer 652 having a thickness of 4 mm that covers the core 651, for example.

The upper pressure application roller 63 is rotated and driven by the rotation and drive of the drive lower pressure application roller 65 that contacts the upper pressure application roller 63. For instance, the upper pressure application roller 65 is pressed against the lower pressure application roller 65 by an elastic body, such as a spring, in the contacting direction. The roller that rotates by receiving the rotation of the drive roller may be referred to as a second rotation member.

In the first embodiment, the lower pressure application roller 65 that is on the drive side, and the upper pressure application roller 63 that is on the driven side that is rotated and driven by the contacting lower pressure application roller 65 are discussed as an example. However, the upper pressure application roller 63 may be on the drive side, and the lower pressure application roller 65 may be on the driven side.

The fusing film 64 that is a heat supply part is an endless member for supplying heat to the carried sheet as well as for carrying the sheet. The fusing film 64 is an example of a heating member.

The fusing film 64 is tensioned on the fuser heater 61, the upper pressure application roller 63 and the heater support member 75. The fusing film 64 receives heat applied to the fusing film 64 from the fuser heater 61 and is rotated by the rotation of the upper pressure application roller 63 and the lower pressure application roller 65. Because the upper pressure application roller 63 and the lower pressure application roller 65 contact each other via the fusing film 64, the heat is applied to the sheet on which the toner image is carried, at the fusing nip part where the sheet passes.

As the fusing film 64, a base body made of a highly heat resistant polyimide resin with a thickness of 100 μm with a releasing layer made of silicon rubber having at thickness of 200 μm that is formed on the surface of the base body may be used. Moreover, one that has a small heat capacity and excellent heat responsiveness may be used. The base of the fusing film 64 may be made of metal, such as stainless steel and nickel, or made of rubber.

In the first embodiment, a case where the fusing film 64 is tensioned along the outer circumference of the upper pressure application roller 63 is discussed as an example. However, the film 64 may be configured to be tensioned along the outer circumference of the lower pressure application roller 65. In that case, the fuser heater 61 and the heater support member 75 are arranged near the lower pressure application roller 65 and are arranged at a position to tension the fusing film 64.

As discussed above, the fuser thermistor 62 that is a rotation member temperature detection part is a temperature detection member that detects a surface temperature of the fusing film 64.

In addition, as also discussed above, the pressure application thermistor 69 that is a temperature detection part is a pressure application member temperature detection member that detects a surface temperature of the lower pressure application roller 65.

For example, elements that change their resistance values in response to temperature may be used as the fuser thermistor 62 and the pressure application thermistor 69. As a result, the print controller 100 detects the resistance values from the fuser thermistor 62 and the pressure application thermistor 69 and recognizes the respectively detected temperatures of the fuser thermistor 62 and the pressure application thermistor 69. In the first embodiment, elements having characteristics that the resistance values decrease in accordance with the increase in temperature are used as the fuser thermistor 62 and the pressure application thermistors 69.

Moreover, a case where the fuser thermistor 62 contacts the surface of the fusing film 64 at a center part thereof in its longitudinal direction is discussed as an example. However, the position at which the fuser thermistor 62 is arranged is not limited thereto. In addition, the fuser thermistor 62 may contact the inner surface of the fusing film 64 or may not contact the surface of the fusing film 64.

Similarly, a case where the pressure application thermistor 69 contacts the surface of the lower pressure application roller 65 at a center part thereof in its longitudinal direction is discussed as an example. However, the position at which the pressure application thermistor 69 is arranged is not limited thereto. In addition, the pressure application thermistor 69 may not contact the surface of the lower pressure application roller 65.

The fuser heater 61 is a heating member that generates heat in response to the power supply from heater power source 16 and heats the fusing film 64. In the embodiment, the heating member includes the fuser heater 61 and the fusing film 64. The fusing film 64 is a rotating part. The fuser heater 61 may heat the tensioned fusing film 64 by contacting the fusing film 64 or may heat the fusing film 64 in a non-contact manner.

Figure 6:
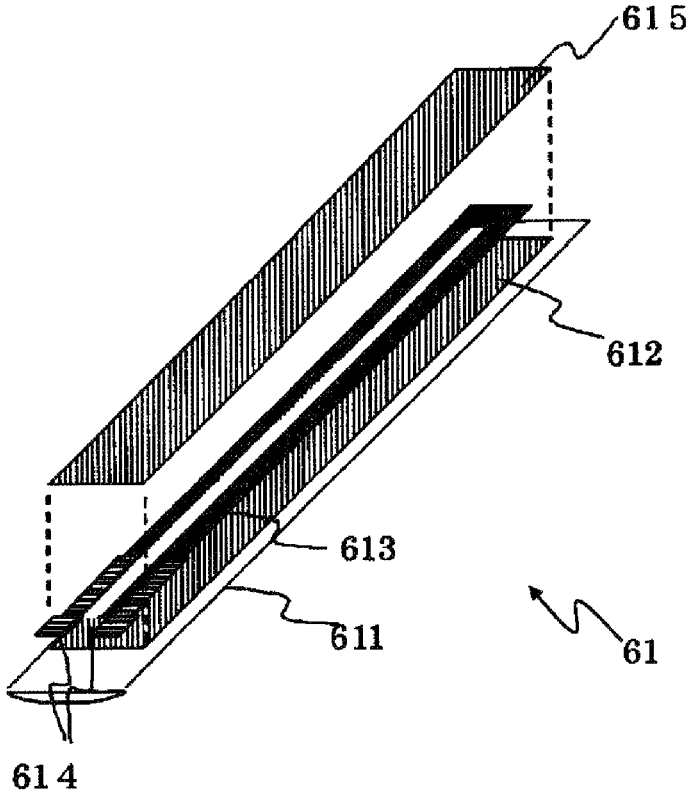
FIG. 6 is a structural diagram illustrating a structure of a fuser heater of the first embodiment.

FIG. 6 is a structural diagram illustrating a structure of the fuser heater 61 of the first embodiment. In FIG. 6, the fuser heater 61 includes a substrate 611, an electric insulation layer 612, a resistant heat generation body 613, electrodes 614 and a protective layer 615.

For instance, the fuser heater 61 is formed by forming a thin glass film as the electric insulation layer 612 on the substrate 611 made of stainless steel (e.g., ferrite-based stainless steel material SUS430 and the like) and by applying, on the glass film, the resistance heat generation body 613 in paste form by screen-printing metal powder, such as nickel-chrome alloy or silver-palladium alloy. In addition, the electrodes 614 are formed at an end part of the fuser heater 61 with a chemically stable metal with small electric resistance, such as silver, or a high melting point metal, such as tungsten. Moreover, the resistance heat generation body 613 and the electrodes 614 are protected by the protective layer 615 made of glass or a representative fluorine-based resin, such as polytetrafluoroethylene (PTFE), perfluoroalkoxyalkane (PFA), and perfluoro ethylene-propene copolymer (FEP) and the like.

The electrodes of the fuser heater 61 are connected to the heater power source 16, and the fuser heater 61 generates heat as a voltage from the heater power source 16 is applied thereto. For example, the voltage is 100 V, and the output of the fuser heater 61 is 1200 W.

The heater support member 75 is a member that supports the fuser heater 61. In addition, the heater support member 75 has a function to tension the fusing film 64.

For example, a metal made of aluminum having high heat conductivity is used for the heater support member 75. In addition, the heater support member 75 maintains a good contact state with the fusing film 64 which may be disrupted by warping of the fuser heater 61 and the like, and has a function as a conductive member that conducts heat from the back side of the heater to the fusing film 64 as a result of its high conductivity.

(A-2) Operation of First Embodiment

Next, processing operation in the image forming apparatus 1A according to the first embodiment is explained with reference to the drawings.

(A-2-1) Overall Flow of Image Formation Process

Figure 7:
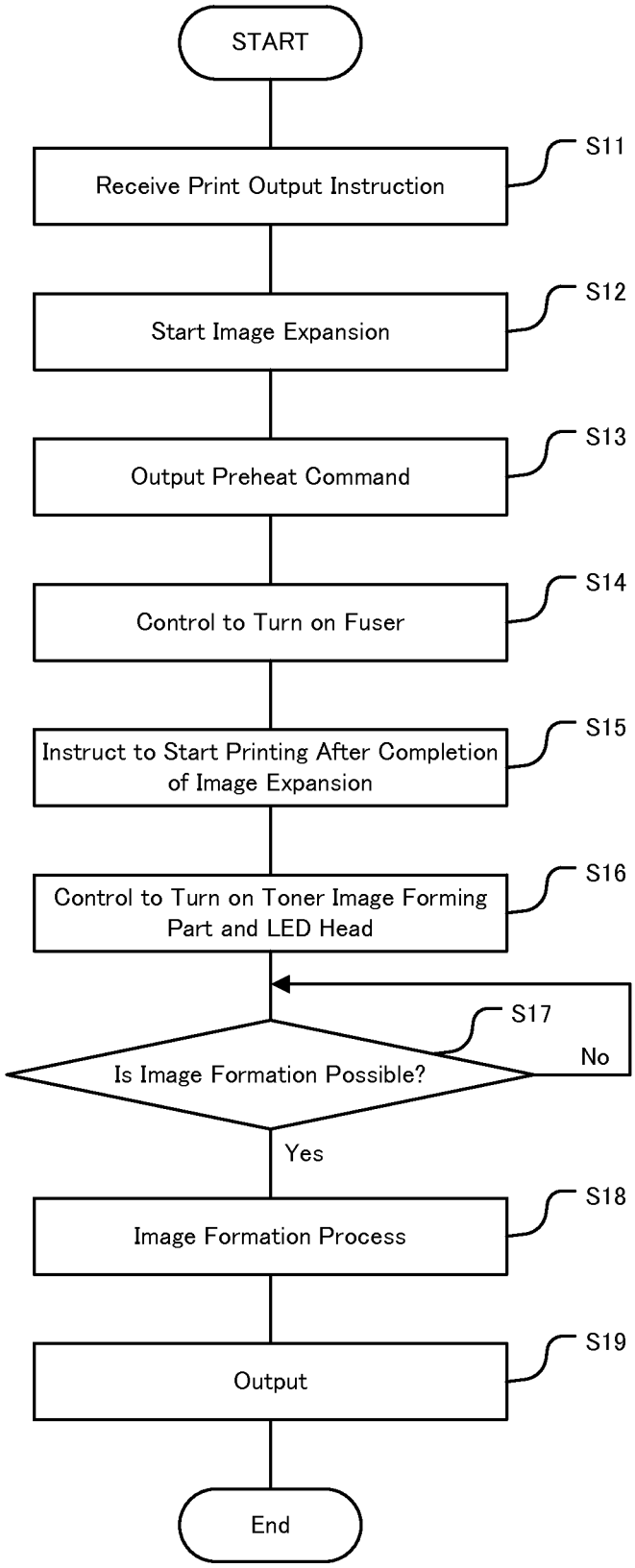
FIG. 7 is a flow diagram illustrating a flow from an image formation instruction from an external device to completion of image formation in the image forming apparatus according to the first embodiment.

FIG. 7 is a flow diagram illustrating a flow from an image formation instruction from an external device 1002 to completion of image formation in the image forming apparatus according to the first embodiment. The process shown in FIG. 7 is achieved as the video controller 1001 and the print controller 100 reads out and executes the control programs stored in the ROM.

First, the external device 1002 outputs a print output instruction and image data including text, figures and the like, for example, to the image forming apparatus 1A. At the image forming apparatus 1A, the video controller 1001 receives the print output instruction and the image data from the external device 1002 (S11).

The video controller 1001 starts image process (image expansion) based on the image data obtained from the external device 1002 (S12). At this time, the video controller 1001 outputs a preheating command to the print controller 100 at the same time as the commencement of the image expansion, in order to preheat the fuser 6 (S13). As a result, the print controller 100 performs a control on the motor power source 20 to start the fuser 6 (S14). That is, the print controller 100 performs a preheating control to start the fuser heater 61 and preheating control on the fuser motor 21.

When the image expansion based on the image data is completed at the video controller 1001, the video controller 1001 outputs a print start command for starting the print operation and a video signal SG to the print control 100 (S15).

When the print controller 100 obtains the print start command from the video controller 1001, the print controller 100 performs a control to start the toner image forming part 5 and the LED head 3 (S16). More specifically, the print controller 100 confirms whether or not a target temperature has reached for the fuser 6 based on the detected temperature information from the fuser thermistor 62 and the pressure application thermistor 69 and performs a temperature control on the fuser heater 61.

Then, when the preparation of the image formation operation has completed (S17), the print controller 100 executes the operation of the image formation process using the obtained video signal SG1 (S18) and outputs a printed sheet (S19).

In other words, the operation of the above-described image formation process can be started when conditions, such as that the fuser 6 is heated to a printable temperature and that the preparation of high voltage has been completed, are satisfied.

In addition, the print controller 100 controls a print sequence of the entire image forming apparatus 1A and performs the print operation based on the print start command and the video signal SG2 from the video controller 1001.

That is, when the print controller 100 receives the print command, the print controller 100 controls the motor power source 20 to transmit the drive force of the fuser motor 21 to the lower pressure application roller 65 via gears, thereby causing the lower pressure application roller 65, the upper pressure application roller 63 and the fusing film 64 to be rotated.

In addition, using the fuser thermistor 62, the print controller 100 detects whether the fuser 6 that includes the built-in fuser heater 61 is in a usable temperature range. If the temperature of the fuser 6 is not within a predetermined temperature range, the print controller 100 turns on electricity to the fuser heater 61 to heat the fuser 6 to the usable temperature.

When the fuser 6 is heated to the usable temperature range, the print controller 100 causes the sheet carrying part 4 to start the sheet carriage.

When the print controller 100 determines, based on the detection result of the writing sensor 8, that the sheet carrying position has reached the printable position, the print controller 100 outputs a timing signal SG3 (signal including a main scanning synchronization signal and a subscan synchronization signal) to the video controller 1001.

The video controller 1001 edits the video signal SG2 for each page and outputs the video signal SG2 of each page to the print controller 100.

The print controller 100 forwards the video signal SG2 from the video controller 1001 to the LED head 3 as a print data signal.

Here, on the LED head 3, a plurality of LEDs each provided for printing 1 dot (pixel) are linearly arrayed. Therefore, when the LED head 3 exposes the photosensitive drum 51, the information emitted from the LED head 3 forms a latent image with dots at which a surface potential of the negatively charged photosensitive drum 51 rises.

Then, at a development part, the negatively charged toner is attracted to each dot due to electric attraction, and thereby a toner image is formed on the surface of the photosensitive drum 51.

Thereafter, when the sheet is carried to the fuser 6 by the sheet carrying part 4, the image on the sheet is fused by the heat and pressure of the fuser 6, and the sheet is ejected.

(A-2-2) Fuser Control Process

Next, a fuser control process of the fuser control device 10 of the first embodiment is explained in detail with reference to the drawings.

The explanation is made above that the video controller 1001 performs image process, such as image expansion, at S12 in FIG. 7.

Here, it is preferable that the print preparation is completed in advance so that the print operation can be executed at the time of the completion of image process, such as image expansion, in case when the image expansion at the video controller 1001 take long time. This is because the printing can be started after the print preparation has been completed, thereby improving productivity.

However, if the electricity to the fuser heater 61 is turned on or if the rotation drive is performed on the fuser roller at an early stage during the image expansion and the like as done conventionally, the fusible temperature (or printable temperature) is reached at shorter time than the time for the image expansion by the video controller 1001. This causes the fuser 6 to await the subsequent completion of image expansion by the video controller 1001.

Therefore, the print controller 1001 continues to adjust at a high temperature until the completion of image expansion. Therefore, the surface temperature of the lower pressure application roller 65 rises higher than normal. As a result, the temperature at the fusing nip part increases more than it is needed.

A problem in this case is that when the sheet passes through the fusing nip part while the lower pressure application roller 65 and the fusing film 64 contact the sheet, the moisture contained in the sheet evaporates and is discharged outside as steam. The steam causes a layer between the lower pressure application roller 65 and the sheet, and a frictional force between the sheet and the lower pressure application roller 65 decreases. Because the sheet follows and is carried by the frictional force, the sheet cannot be carried with the decreased frictional force as it slips, resulting a slip phenomenon to occur. This causes occurrence of sheet jam.

However, if the preparation of the image forming part is started after the completion of image expansion in order to prevent the slip, the time to the completion of printing takes too long, causing inability to perform a speedy print operation.

Figure 8:
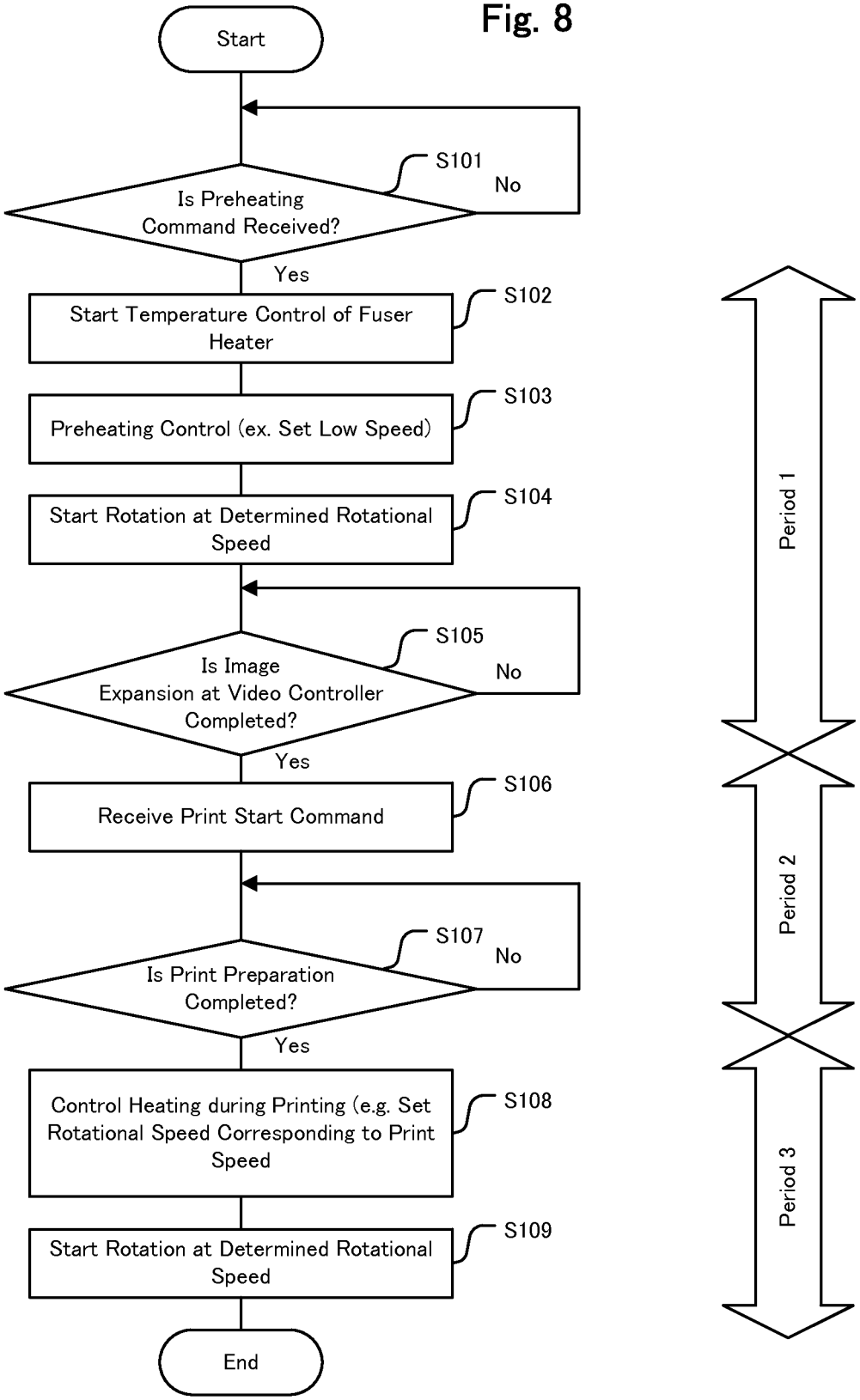
FIG. 8 is an explanatory diagram explaining a detailed operation of a fuser control process by the fuser control device according to the first embodiment.

Therefore, in the first embodiment, the fuser control device 10 performs the fuser control process shown in FIG. 8.

FIG. 8 is an explanatory diagram explaining a detailed operation of a fuser control process by the fuser control device 10 according to the first embodiment.

First, as discussed above, when a print output instruction and image data including text, drawings and the like are provided to the video controller 1001 from the external device 1002, the video controller 1001 outputs a preheating command to the print controller 100.

Here, in a case of the conventional image forming apparatus, the video controller does not output the preheating command prior to outputting the print start command. Therefore, even after the print start command is generated after the completion of print expansion, the conventional image forming apparatus needs to complete the print preparation and thus cannot start the print operation until after the completion of the print preparation. In contrast, according to the first embodiment, as the video controller 1001 outputs the preheating command prior to outputting the print start command, the print controller 100 can perform a temperature control on the fuser 6 before the print preparation is completed.

The print controller 100 detects whether or not the preheating command from the video controller 1001 has been received (S101).

If the print controller 100 has received the preheating command, the print controller 100 starts controlling the fuser heater 61 and the fuser motor 21 by turning on the heater power source 16 and the motor power source 20, and starts the temperature control of the fuser (S102).

At this time, at the print controller 100, the heating controller 102 performs the temperature control on the fuser 6, that is, the control of the surface temperature of the fusing film 64. In addition, the motor controller 101 performs a preheating control for driving and controlling the fuser motor 21. That is, the motor controller 101 starts rotating and driving the fuser motor 21 at a preset low rotational speed (S103, S104).

Here, the rotation and driving control by the motor controller 101 using a preheating control and the temperature control of the fuser 6 by the heating controller 102 are explained.

For example, when an A4 size sheet is carried in landscape (width: 297 mm), the motor controller 101 that performs the preheating control controls the fuser motor 21 so that the lower pressure application roller 65 is driven at a low rotational speed that corresponds to 10 pages per minute (ppm). That is, the motor controller 101 controls the fuser motor 21 so that the sheet carrying speed at the fusing nip part becomes 45 mm/s.

Moreover, the heating controller 102 determines whether or not the detected temperature from the fuser thermistor 62 is within a predetermined printable temperature range. If the detected temperature is within the printable temperature range, the heating controller 102 starts the sheet carriage.

Here, the printable temperature range is a temperature range in which the toner can be fused onto the sheet. The lower limit temperature is T1, and the upper limit temperature is T2. For example, in the first embodiment, T1 and T2 are 175° C. and 205° C., as examples, respectively. However, the configuration of the printable temperature range is not limited there these.

If the detected temperature of the fuser thermistor 62 is higher than the upper limit temperature T2, the heating controller 102 terminates power supply from the heater power source 16 to the fuser heater 61 to decrease the surface temperature of the fusing film 64 (hereinafter, also referred to as "cool down").

If the detected temperature of the fuser thermistor 62 is lower than the lower limit temperature T1, the heating controller 102 allows the power supply from the heater power source 16 to the fuser heater 61 (by increasing supply voltage value) to increase the surface temperature of the fusing film 64 (hereinafter, also referred to as "warm up").

The heating controller 102 controls the surface temperature of the fusing film 64 within the printable temperature range as discussed above. If necessary, the heating controller 102 may repeat the cool down and warm up controls.

Next, the print controller 100 performs the preheating control until the image expansion is completed at the video controller 1001 (S105). At this time, the fuser 6 rotates and drives at low speed and awaits the completion of the print preparation while continuing the control of the fuser heater 61 by the heating controller 102.

When the image expansion is completed, the video controller 1001 sends a command of the completion of the image expansion to the print controller 100. When the print controller 100 receives the command, resulting in the image expansion completed (S105). Thereafter, when the print controller 100 receives the print start command from the video controller 1001, the print controller 100 starts the print preparation (S106).

Then, when the print preparation (or image forming preparation) is completed (S107), the print controller 100 performs a print heating control to perform a drive control on the fuser motor 21 (S108). That is, the print controller 100 causes the motor controller 101 to start rotating and driving the fuser motor 21 at a rotational speed corresponding to the print speed that is faster than the rotational speed during the preheating control (S109).

For example, when an A4 size sheet is carried in landscape (width: 297 mm), the motor controller 101 that performs the heating control controls the fuser motor 21 so that the lower pressure application roller 65 is driven at a fast rotational speed that corresponds to 50 ppm. In this case, the motor controller 101 controls the fuser motor 21 so that the sheet carrying speed at the fusing nip part becomes 225 mm/s.

Thereafter, when the print preparation is completed, the print controller 100 starts the printing. In addition, the control of the fuser heater 21 by the heating controller 102 continues.

By performing the above-described series of processes, the excess temperature increase at the lower pressure application roller is suppressed even if the time for image expansion at the video controller 1001 takes long. Therefore, the occurrence of slips is prevented.

Next, the exemplary operation of the image forming apparatus 1A of the first embodiment is explained in comparison with the exemplary operation of the conventional image forming apparatus.

Figure 9:
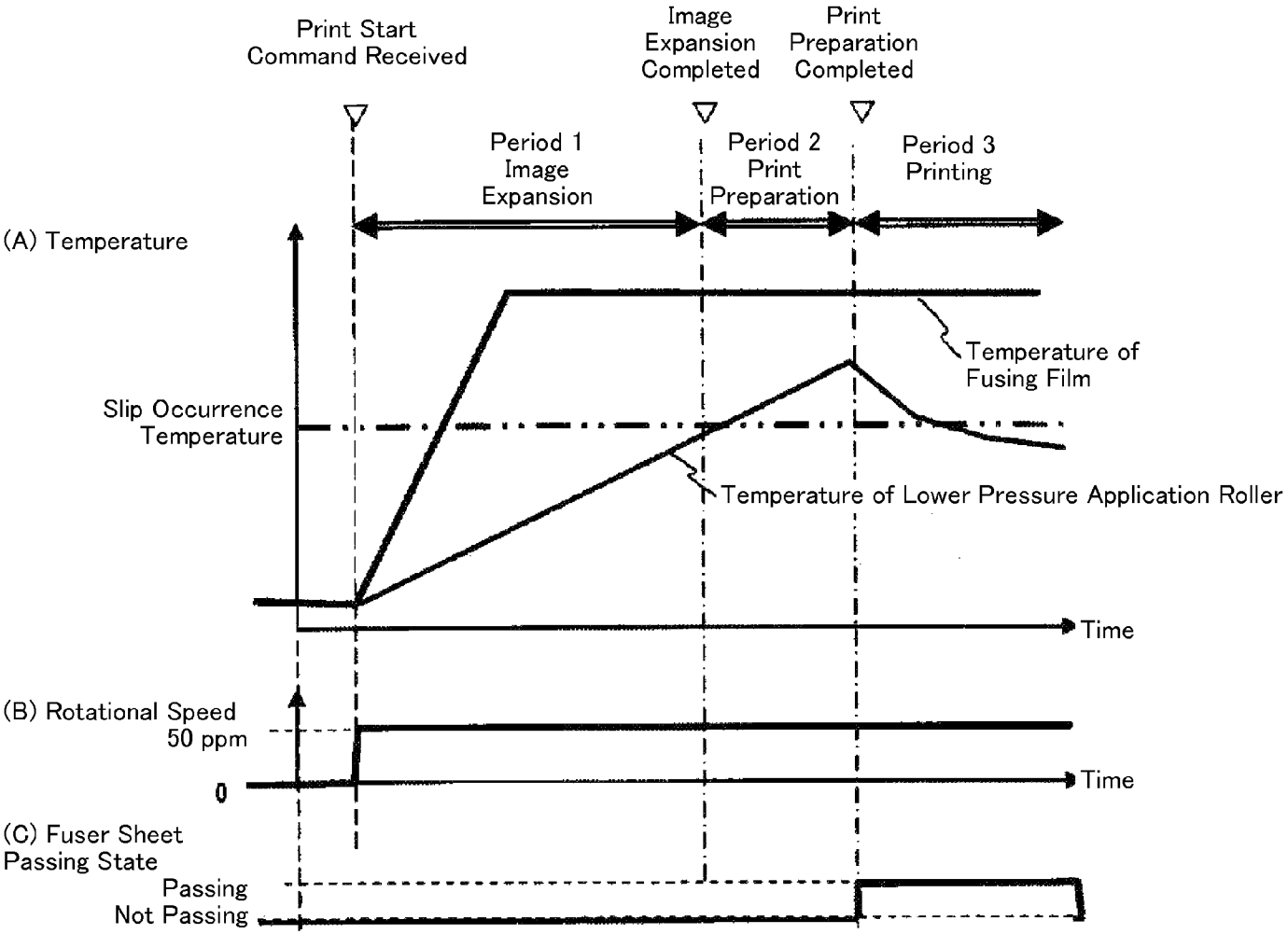
Fig. 9 Prior Art
FIG. 9 is an explanatory diagram explaining an exemplary operation of a conventional image forming apparatus.

FIG. 9 is an explanatory diagram explaining the exemplary operation of the conventional image forming apparatus. FIG. 9 exemplarily illustrates a case where the conventional print controller controls the turning on the fuser heater 61 and the fuser motor 21 after receiving the print start command.

In this embodiment, a period, which is from the print controller receiving the preheating command up to the image expansion being completed, is defined Period 1. The next period, which is from the image expansion being completed up to the print preparation being completed, is defined Period 2. The next period, which is after the print preparation being completed, is defined Period 3.

Figure 10:
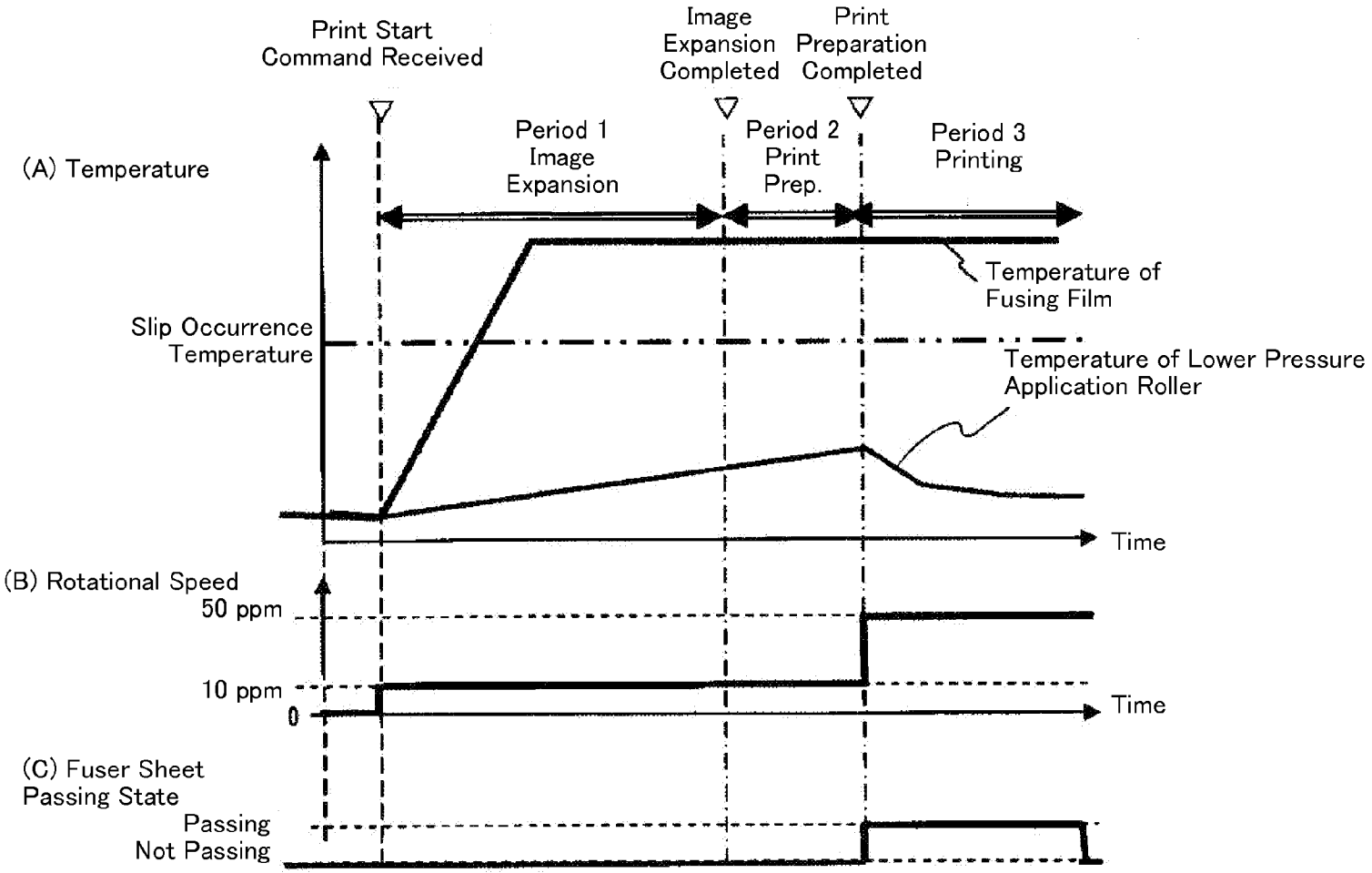
FIG. 10 is an explanatory diagram explaining an exemplary operation of the image forming apparatus of the first embodiment (Part 1).
Figure 11:
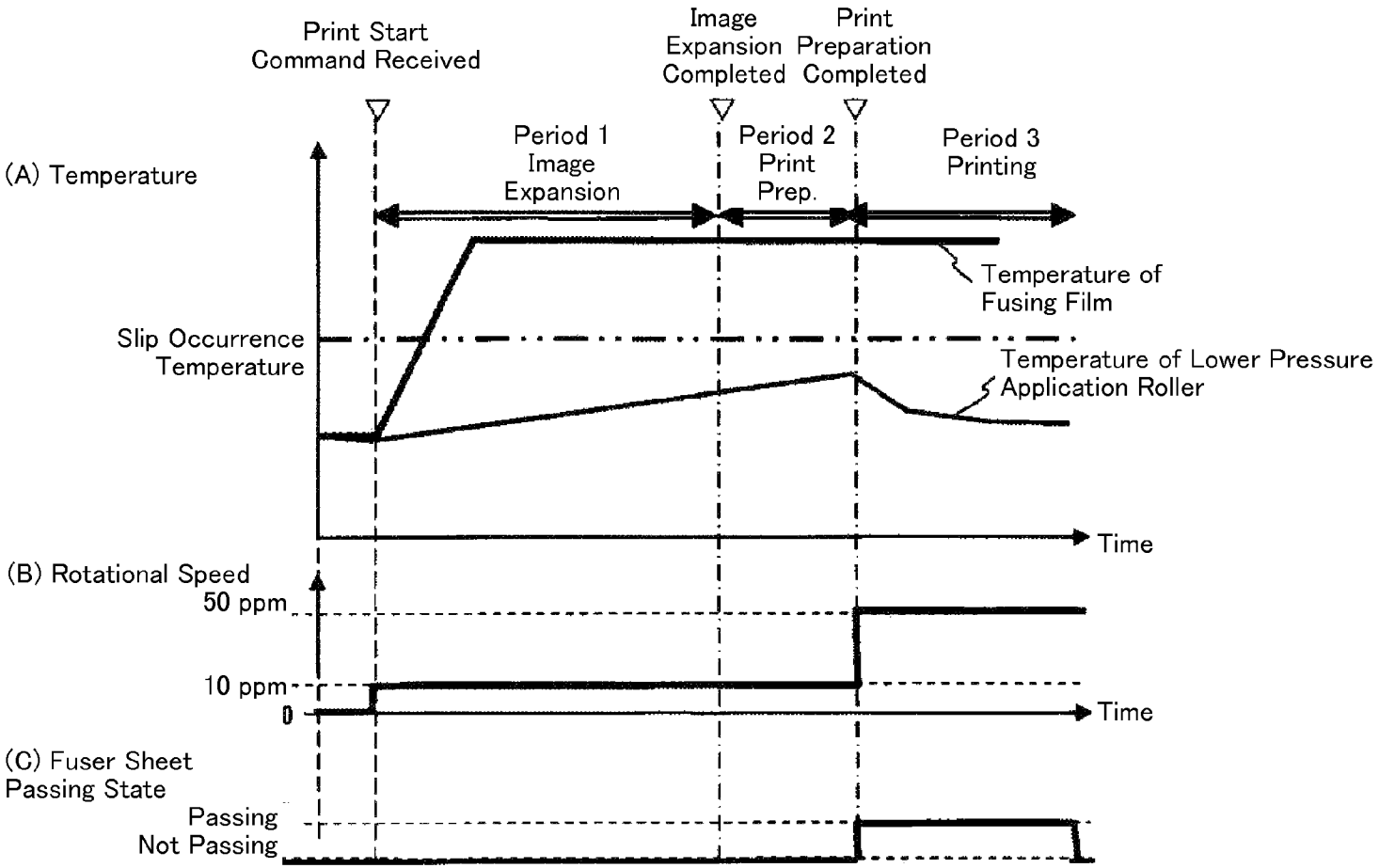
FIG. 11 is an explanatory diagram explaining the exemplary operation of the image forming apparatus of the first embodiment (Part 2).

FIGS. 10 and 11 are explanatory diagrams explaining the exemplary operation of the image forming apparatus 1A of the first embodiment. FIG. 10 is an operation result of a case where the temperature of the fusing film 64 and the lower pressure application roller 65 at the time of receiving the preheating command is relatively low. FIG. 11 is an operation result of a case where the temperature of the fusing film 64 and the lower pressure application roller 65 at the time of receiving the preheating command is relatively high.

In FIGS. 9, 10 and 11, (A) indicates the fusing film temperature and the pressure application roller temperature of the fuser 6. Double-dot chain lines indicate a temperature at which slips occur if the pressure application roller temperature increases more than such temperature. In FIGS. 10 and 11, the Periods 1 to 3 are identical to the periods in FIG. 9.

In FIGS. 9, 10 and 11, (B) indicates a rotational speed of the fuser motor controlled by the motor controller 101, and (C) indicates a sheet passage state at the fuser (fuser sheet passage state) that is determined based on the detection result of the writing sensor 8.

In FIG. 9, "Period 1" is a period during which the video controller outputs a print start command at the same time as image expansion and during which the print controller heats the fuser as the print preparation for the fuser after receiving the print start command.

At this time, the fuser motor rotates at a rotational speed in response to a speed (e.g., corresponding to 50 ppm) requested by the print request. Therefore, it is understood that the temperature of the lower pressure application roller rises at high speed.

Next, "Period 2" is a period from the completion of image expansion to the completion of print preparation. When the print controller receives an image expansion completion signal, the print controller starts the print preparation. However, the print controller does not change the control of the fuser and awaits the completion of the print preparation.

Therefore, it is understood that the temperature of the lower pressure application roller exceeds the slip occurrence temperature in the "Period 2" in (A) Temperature shown in FIG. 9A. In FIG. 9, longer the image expansion time in "Period 1" extends, further the temperature of the lower pressure application roller increases.

Hence, in "Period 3", the slip may occur at the time of starting the printing because the printing is performed while the temperature of the lower pressure application roller is high.

Next, in "Period 1" in FIG. 10, the fuser motor 21 rotates at the lower speed (e.g., corresponding to 10 ppm). That is, the fuser motor 21 does not rotate at a speed (e.g., corresponding to 50 ppm) requested by the print request but rotates at the lower speed. Therefore, the temperature of the lower pressure application roller 65 increases more moderately than the case in FIG. 9.

Next, in "Period 2", when the print controller 100 receives the print start command after the image expansion, the print controller 100 starts the print preparation. At this time, the print controller 100 does not change the control of the fuser 6 and awaits the completion of the print preparation.

Moreover, even if the image expansion takes long time, the rotational speed of the lower pressure application roller 65 is low. Therefore, the temperature of the lower pressure application roller does not exceed the slip occurrence temperature.

Here, a relationship between the rotational speed of the fuser 6 and the temperature of the lower pressure application roller 65 is explained with reference to FIG. 12.

Figure 12:
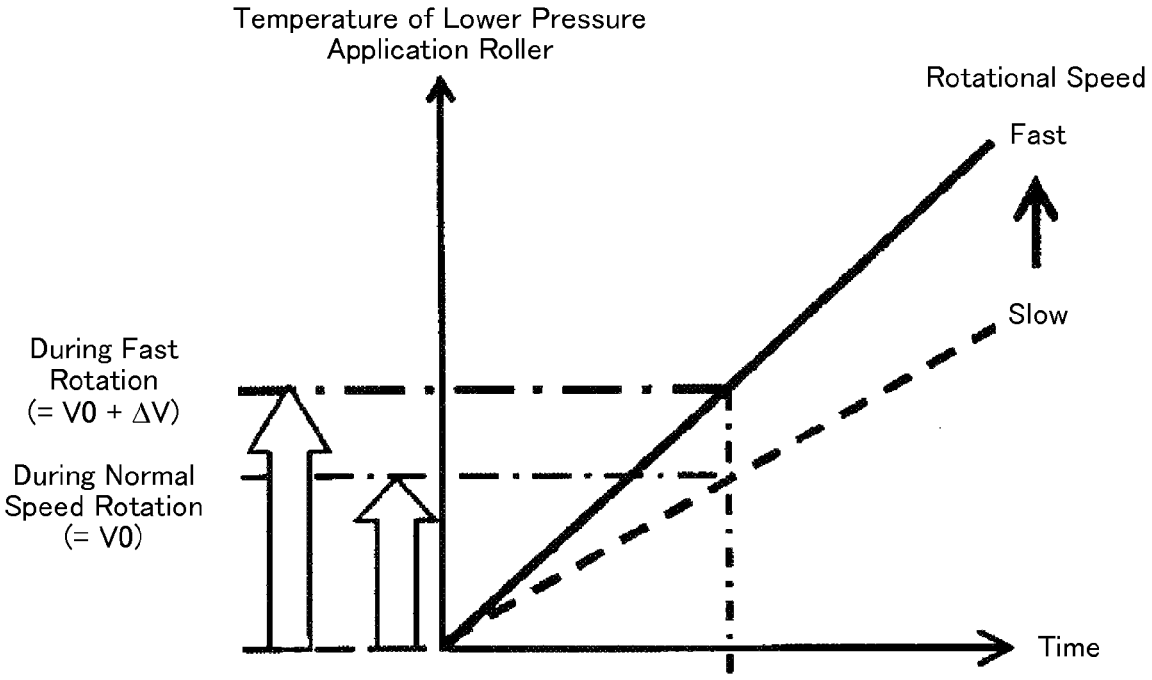
FIG. 12 is an explanatory diagram explaining relationship between rotational speed of the fuser and a surface temperature of a lower pressure application roller.

FIG. 12 is an explanatory diagram explaining relationship between rotational speed of the fuser 6 and a surface temperature of a lower pressure application roller 65. In FIG. 12, the horizontal axis and the vertical axis indicate driving time and a surface temperature of the lower pressure application roller 65, respectively. Moreover, in FIG. 12, the solid line indicates a case where the fuser 6 is rotated and driven at a high speed, and the broken line indicates another case where the fuser 6 is rotated and driven at a low speed.

It is understand from FIG. 12 that, comparing the case of the high speed and the case of the low speed, the temperature of the lower pressure application roller 65 is higher at the same driving time in the case of the high speed.

This is because the frequency that the fusing film 64 at the high temperature and the lower pressure application roller 65 at the low temperature contact increases (contact time lengthens) as the rotational speed increases, and as a result, because the heat of the fusing film 64 is more frequently transferred to the lower pressure application roller 65.

In other words, as shown in FIG. 10, by setting the rotational speed low (e.g., corresponding to 10 ppm), the temperature increase at the lower pressure application roller 65 can be suppressed.

Thereafter, when the print preparation is completed at "Period 3," and when the print controller 100 switches the rotation and drive to the high speed corresponding to the print speed (e.g., corresponding to 50 ppm) at the time of starting the printing, the temperature of the lower pressure application roller 65 begins to rapidly increases. However, because the slip occurrence temperature is not exceeded at the time when the sheet reaches the fuser 6, the occurrence of slips is prevented even if the sheet is passed thereafter.

Moreover, FIG. 11 illustrates a case where the temperature of each configuration element of the fuser 6 at the time when the print controller 100 receives the preheating command is higher than the case shown in FIG. 10.

Even in this case, similar to the case shown in FIG. 10, the speed of increase in the temperature of the lower pressure application roller 65 can be controlled at a low level by setting the rotational speed of the fuser motor 21 at low speed (e.g., corresponding to 10 ppm) in "Period 1" and "Period 2." Therefore, similar to the case shown in FIG. 10, because the slip occurrence temperature is not exceeded at the time when the sheet reaches the fuser 6 at "Period 3", the occurrence of slips is prevented even if the sheet is passed thereafter.

(A-3) Effect of First Embodiment

As discussed above, according to the first embodiment, the print controller controls the temperature of the lower pressure application roller at the time of staring the printing lower than the slip occurrence temperature based on the preheating command from the video controller prior to the completion of the print preparation. Therefore, the occurrence of slip is prevented. For instance, even if the image expansion at the video controller takes longer time, the occurrence of slip is prevented according to the first embodiment.

(B) Second Embodiment

Next, a second embodiment of the fuser control device, the fuser control method and the image forming apparatus of this invention is explained below in detail with reference to the drawings.

(B-1) Structure of Second Embodiment

The image forming apparatus and the fuser control device of the second embodiment are different in functions of the print controller from those of the first embodiment. Therefore, the second embodiment is explained using FIGS. 2, 3, 5 and 6 of the first embodiment, and a structure and operation of the print controller of the second embodiment are explained in detail.

Figure 13:
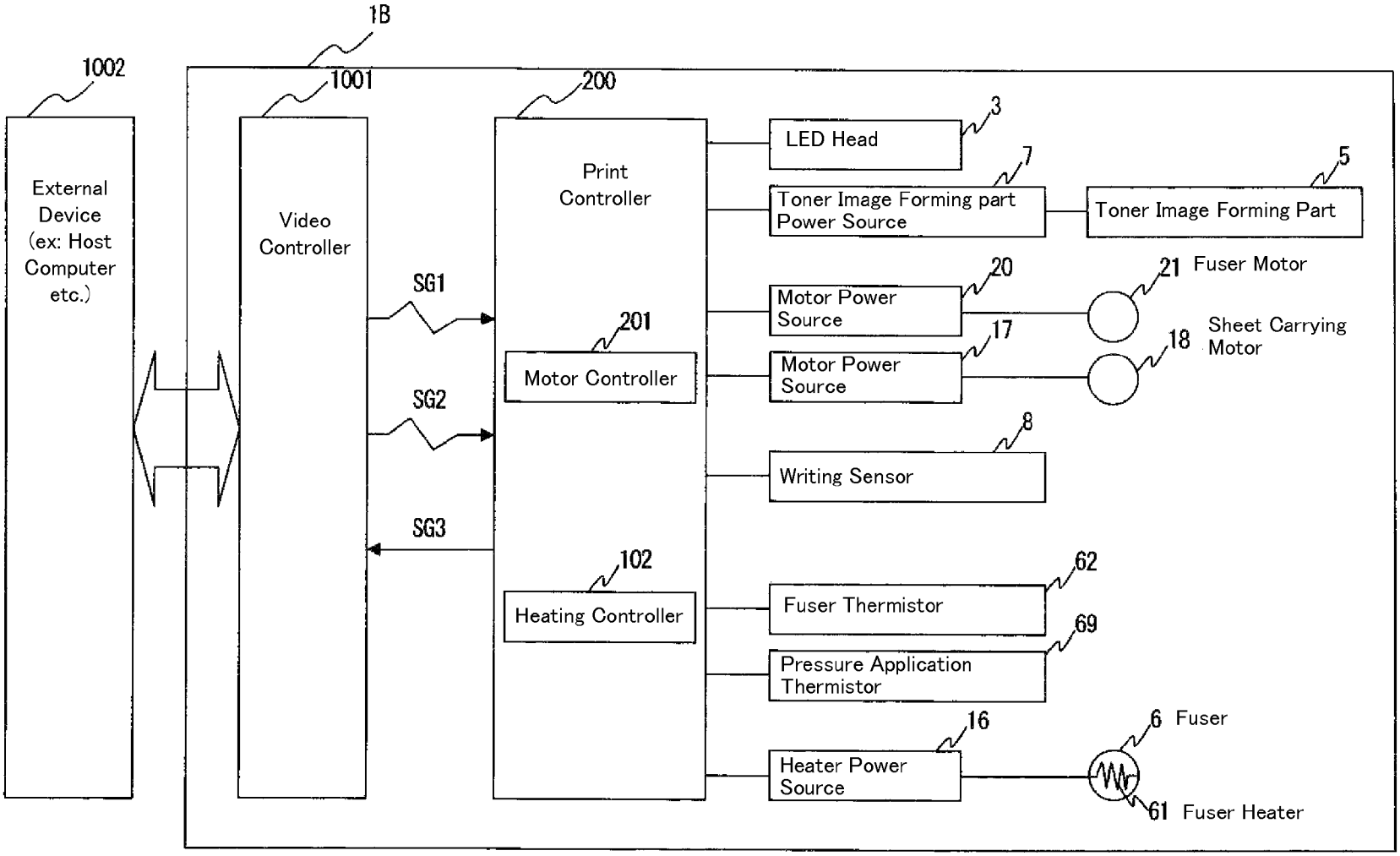
FIG. 13 is a structural diagram illustrating the internal structure of the control system of the image forming apparatus according to a second embodiment.

FIG. 13 is a structural diagram illustrating the internal structure of the control system of an image forming apparatus 1B according to the second embodiment.

In FIG. 13, the image forming apparatus 1B according to the second embodiment includes a print controller 200 of the second embodiment, the video controller 1001 as controllers, the LED head 3, the toner image forming part power source 7, the motor power source 20, the motor power source 17, the writing sensor 8, the fuser thermistor 62, the pressure application thermistor 69, the heater power source 16, the toner image forming part 5, the fuser motor 21, the sheet carrying motor 18, the fuser 6 and the fuser heater 61.

In FIG. 13, similar to the first embodiment, the image forming apparatus 1B is connected to the external device 1002.

Similar to the print controller 100 of the first embodiment, the print controller 200 controls the print operation based on the control signal SG1 from the video controller 1001. The print controller 200 is a device configured by including, for example, a microprocessor, a ROM, a RAM an input/output interface, a timer and the like. Various functions of the print controllers 200 are achieved as the microprocessor executes process programs stored in the ROM.

As shown in FIG. 13, the print controller 200 includes a motor controller 201 and the heating controller 102, as functions achieved by the print controller 200.

Similar to the first embodiment, the heating controller 102 controls a temperature of the fuser heater 61 when a preheating command is received.

Similar to the first embodiment, the motor controller 201 controls operation of the toner image forming part power source 7, the motor power source 20 and the motor power source 17 based on the control signal SG1 from the video controller 1001.

Figure 14:
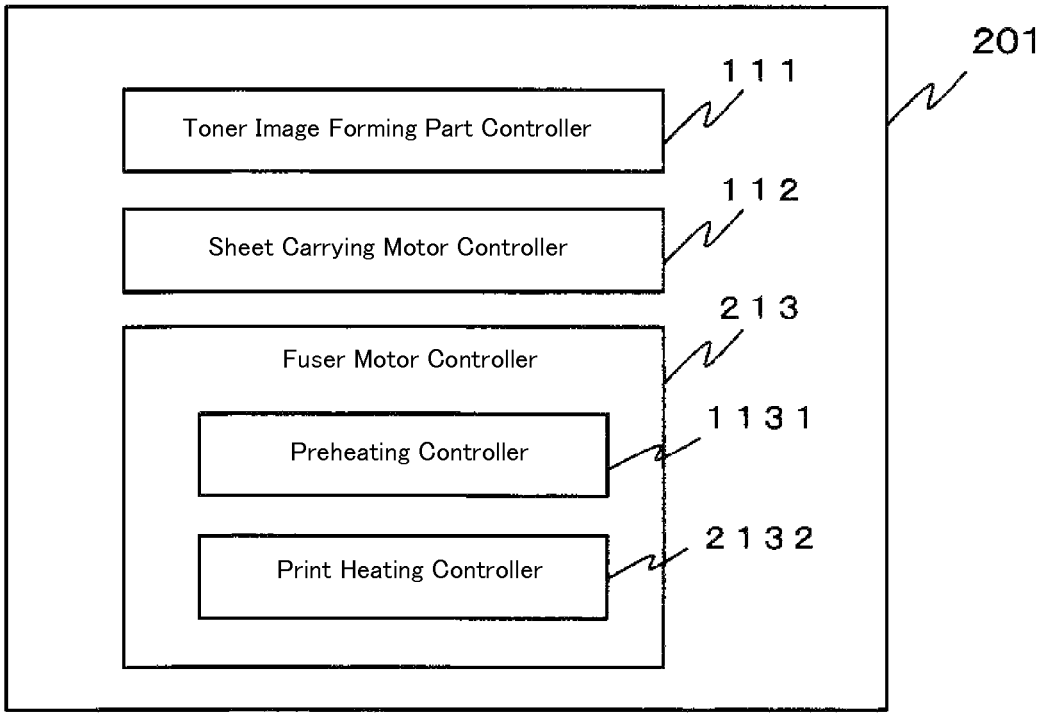
FIG. 14 is a block diagram illustrating the functional structure of the motor controller according to the second embodiment.

FIG. 14 is a block diagram illustrating the functional structure of the motor controller 201 according to the second embodiment.

In FIG. 14, the motor controller 201 includes the toner image forming part controller 111, the sheet carrying motor controller 112, and a fuser motor controller 213. The toner image forming part controller 111 and the sheet carrying motor controller 112 are the same as those of the first embodiment. Therefore, their detailed descriptions are omitted.

The fuser motor controller 213 causes the fuser motor 21 to be rotated and driven at a low speed when the preheating command is received and variably adjusts a rotational speed of the fuser motor 21 at least from the receipt of the preheating command to start of the print so that a surface temperature of the lower pressure application roller 65 does not fall below a curling occurrence temperature.

Here, the curling refers to deformation (warping) of a sheet after the fusing process. Various references for occurrence of the curling may be adapted based on print operation, levels of deformation of the ejected sheet and the like. For example, in the present embodiment, a case where the warping at an end part of the sheet after the fusing process is greater than about 15 mm may be adapted as a reference. Of course, the level of warping at the end part of the sheet is not particularly limited.

It is known for the curling that the amount of deformation of the sheet is greater as a temperature difference between fuser rollers (that is, a temperature difference between the fusing film 64 and the lower pressure application roller 65) at the fusing nip part is more significant. Therefore, it is desired that the temperature difference between the fuser rollers is maintained small in order to prevent the occurrence of the curling.

In the second embodiment, a case where the surface temperature of the fusing film 64 is a predetermined printable temperature is discussed as an example. Therefore, in the second embodiment, the surface temperature of the lower pressure application roller 65 is controlled not to fall below the curling occurrence temperature.

As shown in FIG. 14, the fuser motor controller 213 includes a preheating controller 1131 and a print heating controller 2132.

The preheating controller 1131 causes the lower pressure application roller 65 of the fuser 6 to be rotated and driven at a preset low rotational speed when the preheating command from the video controller 1001 is received.

The print heating controller 2132 controls rotation and drive of the fuser motor 21 at a speed corresponding to the print request when the print start command is received from the video controller 1001 and variable adjust the rotational speed of the lower pressure application controller 65 based on detected temperature information of the pressure application thermistor 69 from the heating controller 102.

That is, the print heating controller 2132 variably controls the fuser motor 21 in response to the temperature of the lower pressure application roller 65.

(B-2) Operation of Second Embodiment

FIG. 15 is an explanatory diagram explaining a detailed operation of the fuser control process by the fuser control device 10 according to the second embodiment. In FIG. 15, processes that are similar to those in FIG. 8 are referenced by the same numbers as those in FIG. 8.

First, similar to the first embodiment, if the print controller 200 has received the preheating command from the video controller 1001, the print controller 200 starts controlling the fuser heater 61 and the fuser motor 21 by turning on the heater power source 16 and the motor power source 20, and starts the temperature control of the fuser (S101, S102).

At this time, at the print controller 200, the motor controller 201 starts rotating and driving the fuser motor 21 at a preset low rotational speed (S103, S104).

After completion of the image expansion (S105), when the print start command is received (S106), at the print controller 200, the motor controller 201 obtains detected temperature information by the pressure application thermistor 69 through the heating controller 102 and sets a rotational speed of the lower pressure application roller 65 based on the detected temperature (S201) and rotates the lower pressure application roller 65 at the rotational speed (S202).

At that time, the motor controller 201 compares the detected temperature of the pressure application thermistor 69 and a preset judgment temperature (curling occurrence temperature).

When the detected temperature (surface temperature of the lower pressure application roller 65)≥the judgment temperature, the motor controller 201 controls the drive of the fuser 21 so that the rotational speed of the lower pressure application roller 65 becomes a low speed.

On the other hand, when the detected temperature (surface temperature of the lower pressure application roller 65)<the judgment temperature, the motor controller 201 controls the drive of the fuser 21 so that the rotational speed of the lower pressure application roller 65 becomes a high speed.

Here, in the second embodiment, a case where the low speed for the lower pressure application roller 65 corresponds to 10 ppm, and the high speed corresponds to 50 ppm, and where the low speed is the same as the speed for the preheating control is explained as an example. However, it is not necessary that the low speed for the lower pressure application roller 65 is the same as the case of the preheating control. For instance, the low speed may be 20 ppm, 30 ppm or the like that is between the low speed (10 ppm) and the high speed (50 ppm).

In addition, in the second embodiment, a case where the motor controller 201 switches the speed between the low speed and the high speed is explained as an example. However, the motor controller 201 may subsequently gradually increase the rotational speed of the fuser motor 21 in a period from the receipt of the print instruction command to the completion of print preparation to control the rotational speed of the lower pressure application roller 65 from the low speed (e.g., corresponding to 10 ppm) to the high speed (e.g., corresponding to 50 ppm).

Further, the judgment temperature is the lowest temperature at which the temperature of the lower pressure application roller 65 after starting the printing can exceed the curling occurrence temperature, when the rotational speed of the lower pressure application roller 65 is set to the low speed at the time of receipt of the print start command. The judgment temperature may be set by experiments. In the present embodiment, 80° C. is used as an example.

That is, when the detected temperature is lower than the judgment temperature, the temperature of the lower pressure application roller 65 does not exceed the slip occurrence temperature but falls below the curling occurrence temperature after the completion of the print preparation and starting the printing, causing the curling to occur, if the print preparation is continued at the low speed.

Therefore, in the second embodiment, when the detected temperature is lower than the judgment temperature, the rotational speed of the lower pressure application roller 65 is set to the high speed, and thereby heat quantity provided to the lower pressure application roller 65 is increased. Therefore, the temperature of the lower pressure application roller 65 after printing is set higher than the curling occurrence temperature.

Moreover, the rotational speed of the lower pressure application roller 65 is at the low speed in the image expansion period. Therefore, the temperature of the lower pressure application roller 65 is controlled not to exceed the slip occurrence temperature after starting the printing.

The operation after S107 is the same as that in the first embodiment. That is, the print controller 200 rotates and drives the lower pressure application roller 65 at the rotational speed corresponding to the print speed after the completion of the print preparation to execute the printing (S107-S109).

Next, the exemplary operation of the image forming apparatus 1B of the second embodiment is explained with reference to the drawings.

Figure 16:
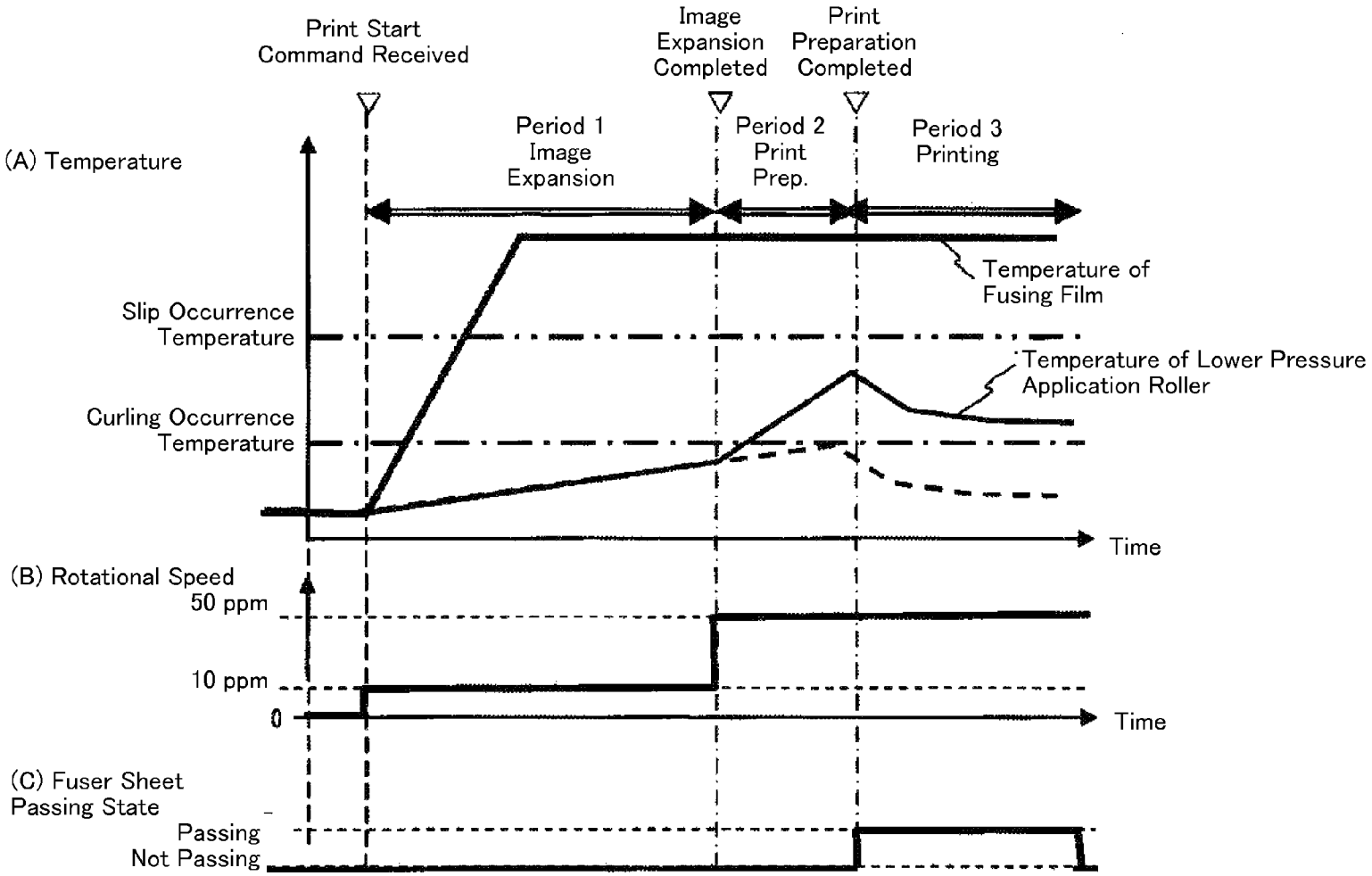
FIG. 16 is an explanatory diagram explaining an exemplary operation of the image forming apparatus of the second embodiment (Part 1).
Figure 17:
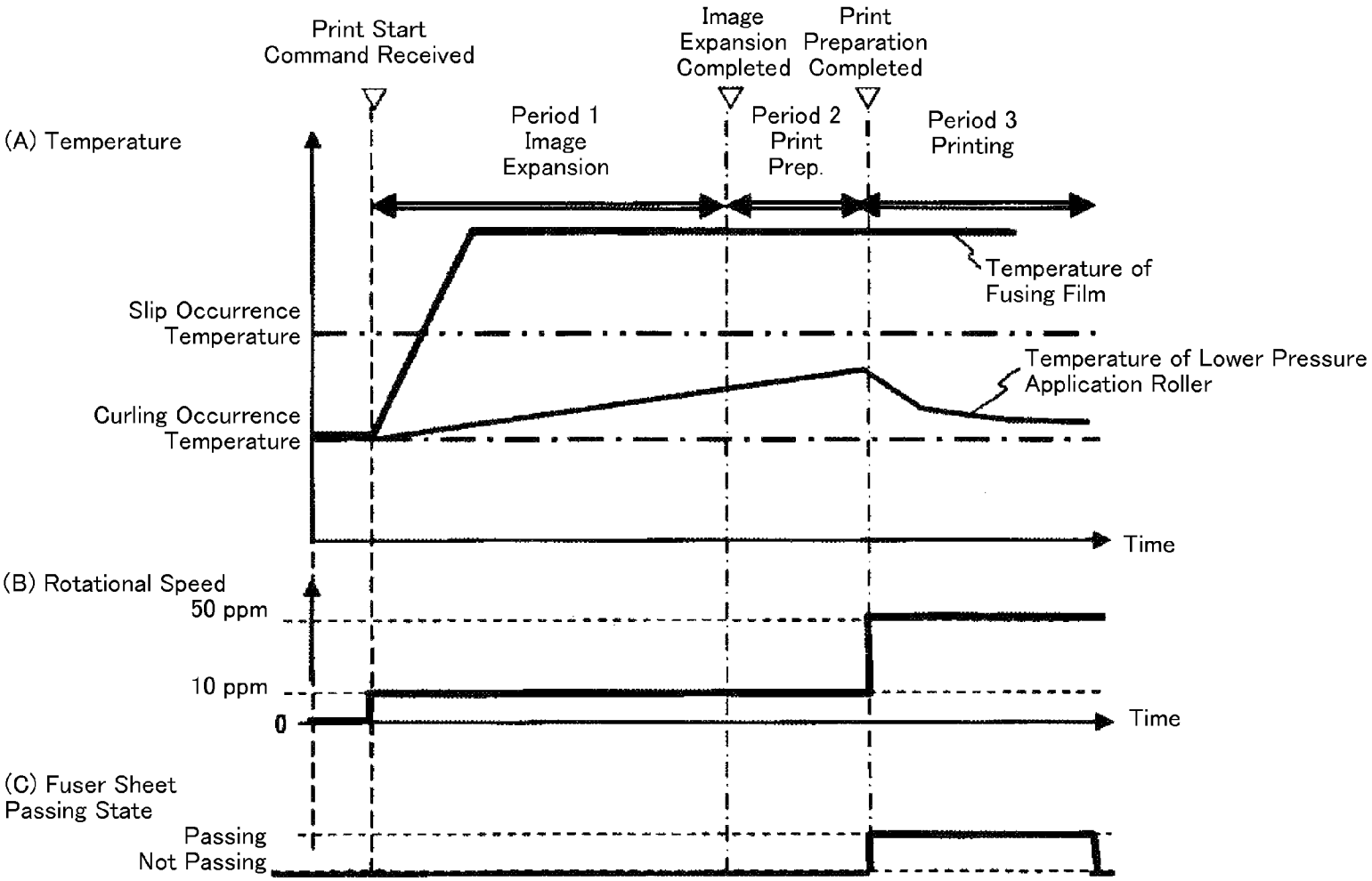
FIG. 17 is an explanatory diagram explaining the exemplary operation of the image forming apparatus of the second embodiment (Part 2).

FIGS. 16 and 17 are explanatory diagrams explaining the exemplary operation of the image forming apparatus 1B of the second embodiment. FIG. 16 is an operation result of a case where the temperature of the fusing film 64 and the lower pressure application roller 65 at the time of receiving the preheating command is relatively low. FIG. 17 is an operation result of a case where the temperature of the fusing film 64 and the lower pressure application roller 65 at the time of receiving the preheating command is relatively high.

In "Period 1" in FIG. 16, the fuser motor 21 rotates at the lower speed (e.g., corresponding to 10 ppm). That is, the fuser motor 21 does not rotate at a speed (e.g., corresponding to 50 ppm) requested by the print request but rotates at the lower speed. Therefore, the temperature of the lower pressure application roller 65 increases more moderately than later-discussed "Period 2" in FIG. 16.

Next, when the print start command is received, the print controller 200 starts the print preparation. At this time, the print controller 200 compares the detected temperature of the pressure application thermistor 69 and the judgment temperature. Here, it is assumed that the detected temperature<the judgment temperature.

In this case, because the temperature of the lower pressure application roller 65 is lower than the curling occurrence temperature, the print controller 200 sets the rotational speed of the fuser 6 at the high speed and waits for the completion of the print preparation. Therefore, during the print preparation in "Period 2", the speed of the increase in temperature of the lower pressure application roller increases.

Here, because the lower pressure application roller 65 rotates at the low speed during the image explanation in "Period 1", the temperature of the lower pressure application roller 65 does not exceed the slip occurrence temperature even at the time of starting the printing at "Period 3" subsequent to the completion of the print preparation thereafter.

Further, because the lower pressure application roller 65 rotates at the high speed during the print preparation in "Period 2", sufficient heat quantity is provided from the fusing film 64 to the lower pressure application roller 65, the temperature of the lower pressure application roller 65 does not fall below the curling occurrence temperature.

As a result, occurrence of slips and occurrence of curling is prevented.

A broken line in section A in FIG. 16 indicates a change in the temperature of the lower pressure application roller if the rotational speed of the lower pressure application roller 65 is kept at the low speed. In this case, the temperature of the lower pressure application roller 65 after printing in "Period 3" falls below the curling occurrence temperature. This is because the heat quantity supplied to the lower pressure application roller 65 from the fusing film 64 is insufficient. As a result, the curling occurs.

In the case shown in FIG. 17, the starting temperature of the lower pressure application roller is higher than the starting temperature shown in FIG. 16. Therefore, the detected temperature of the pressure application thermistor 69 at the time of receipt of the preheating command is equal to or higher than the judgment temperature (detected temperature≥judgment temperature).

In this case, the print controller 200 sets the rotational speed of the lower pressure application roller 65 in "Period 1" and "Period 2" to the low speed. Therefore, the speed of temperature increase of the lower pressure application roller 65 is suppressed low, and the temperature of the lower pressure application roller 65 is sufficiently high. Accordingly, the temperature of the lower pressure application roller 65 does not fall below the curling occurrence temperature.

As a result, the temperature of the lower pressure application roller 65 is controlled so that the temperature of the lower pressure application roller 65 does not exceed the slip occurrence temperature and that the temperature of the lower pressure application roller 65 is higher than the curling occurrence temperature even when the sheet reaches the fuser 6.

In the second embodiment, the explanation is made with the lower pressure application roller 65 at the low and high speeds. However, by making the rotational speed variable in response to the temperature of the lower pressure application roller, the temperature of the lower pressure application roller 65 is controlled more precisely.

(B-3) Effect of Second Embodiment

As discussed above, according to the second embodiment, in addition to the effect of the first embodiment, the surface temperature of the lower pressure application roller is controlled lower than the slip occurrence temperature but higher than the curling occurrence temperature. As a result, the occurrence of the slip as well as the occurrence of the curling are prevented.

(C) Other Embodiments

Various modified embodiments are explained in the above-described first and second embodiments. However, the present invention may be adapted to the following modified embodiments.

In the above-described first and second embodiments, a case where the image forming apparatus is a printer is described as an example. However, the present invention may widely be adapted to a multi-function peripheral (MFP), a photocopy machine and the like, in addition to the printer.

In the above-described first and second embodiments, a case where the fuser uses a fusing film method is described as example. However, the present invention may also be adapted to a heat roller method in which one of the two rollers that the fuser includes is heated. In this case, the present invention may be widely adapted to an internal heating method in which the roller is internally heated, an external heating method in which the roller is externally heated, and the like.

In the above-described first and second embodiments, the rotational speed of the fusing film may be adjusted when the temperature of the fusing film is sufficiently low, such as when the device is in a low temperature (e.g., in case where the temperature of the fusing film is lower than the experimentally predetermined temperature at which the slip easily occurs or the curling occurrence temperature), compared with the case where the temperature of the fusing film exceeds a predetermined value (e.g., the temperature of the fusing film is lower than the experimentally predetermined temperature at which the slip easily occurs or the curling occurrence temperature).

In the present invention, the gap between the high rotational speed (or a rotational speed for image formation) and the low rotational speed (or a rotational speed for preheating) of the fuser motor 21 varies according to the embodiments. However, in view of securing the effect of the invention, it is preferred that the gap is at least 20%.

(Variation of Low Rotational Speed Period)

In the above embodiments, it is disclosed that the low rotational speeds were employed in entire Periods 1 and 2. However, in the light of maintaining the surface temperature of the pressure application roller within a proper range, it may be practical that the low rotational speeds are employed only a portion of the periods. Namely, even when Period 1 is 20 seconds, the pressure application roller rotates at the low speed only for 10 seconds. Further, during Periods 1 and 2, a combination of the low speeds and suspension of the rotation would be applicable. As long as an excessive heating can be avoid, the high speed can be initiated before Period 2.

What is claimed is:

1. A fuser control device that controls a fuser that heats and fuses developer on a medium for an image formation on the medium, comprising:

the fuser including a heating member that rotates while contacting and heating the medium, and a rotation member that rotates and sandwiches the medium with the heating member;

a temperature detection part that detects a temperature of the rotation member; and a rotation controller that causes the heating member to rotate at a first rotational speed before an image formation process, wherein the rotation controller determines a second rotational speed based on the detected temperature before the image formation process, the rotation controller causes the heating member that is rotating at the first rotation speed to rotate at the second rotational speed before the image formation process, the rotation controller causes the heating member to rotate at a third rotational speed that is different from the first rotational speed during the image formation process, and the rotation controller determines the second rotational speed after an image expansion process.

2. The fuser control device according to claim 1, wherein the first rotation speed is slower than the third rotation speed.

3. The fuser control device according to claim 1, wherein the rotation controller adjusts a temperature of a contract part at which the rotation member and the heating member contact by controlling the rotational speed of the rotation member as well as the rotation of the heating member.

4. The fuser control device according to claim 1, wherein the second rotational speed is equal to the first rotational speed.

5. The fuser control device according to claim 1, wherein the second rotational speed is equal to the third rotational speed.

6. The fuser control device according to claim 1, wherein the second rotational speed is slower than the third rotational speed, and the first rotational speed is slower than the second rotational speed.

7. The fuser control device according to claim 2, wherein the rotation controller causes the heating member to rotate at the first rotational speed based on a preheating command, and the rotation controller causes the heating member to rotate at the third rotational speed based on a command for the image formation.

8. A fuser control method for heating and fusing developer on a medium for an image formation using a heating member and a rotation member, the heating member sandwiching the medium with the rotation body, and rotating while contacting and heating the medium, the fuser control method, comprising:

detecting a temperature of the rotation member;

before an image formation process, causing the heating member to rotate at a first rotational speed;

before the image formation process, determining a second rotational speed based on the detected temperature;

before the image formation process, causing the heating member that is rotating at the first rotational speed to rotate at the second rotational speed;

during the image formation process, causing the heating member to rotate at a third rotational speed that is different from the first rotational speed; and after an image expansion process, determining the second rotational speed.

9. The fuser control method according to claim 8, wherein the first rotational speed is slower than the third rotational speed.

10. The fuser control method according to claim 8, wherein the second rotational speed is equal to the first rotational speed.

11. The fuser control method according to claim 8, wherein the second rotational speed is equal to the third rotational speed.

12. The fuser control method according to claim 8, wherein the second rotational speed is slower than the third rotational speed, and the first rotational speed is slower than the second rotational speed.

13. An image formation apparatus that forms an image on a medium, comprising:

a fuser that heats and fuses developer on the medium for the image formation, the fuser including a heating member that rotates while contacting and heating the medium, and a rotation member that rotates and sandwiches the medium with the heating member; and a fuser control device that controls the fuser, the fuser control device including a temperature detection part that detects a temperature of the rotation member, and a rotation controller that causes the heating member to rotate at a first rotational speed before an image formation process, wherein the rotation controller determines a second rotational speed based on the detected temperature before the image formation process, the rotation controller causes the heating member that is rotating at the first rotational speed to rotate at the second rotational speed before the image formation process, the rotation controller causes the heating member to rotate at a third rotational speed that is different from the first rotational speed during the image formation process, and the rotation controller determines the second rotational speed after an image expansion process.

14. The image forming apparatus according to claim 13, wherein the first rotational speed is slower than the third rotational speed.

15. The image formation apparatus according to claim 13, wherein the second rotational speed is equal to the first rotational speed.

16. The image formation apparatus according to claim 13, wherein the second rotational speed is equal to the third rotational speed.

17. The image formation apparatus according to claim 13, wherein the second rotational speed is slower than the third rotational speed, and the first rotational speed is slower than the second rotational speed.

* * * * *